US012788123B2

(12) United States Patent
Howard

(10) Patent No.: US 12,788,123 B2
(45) Date of Patent: Nov. 10, 2026

(54) PHASE CONTROL HEATER CONTROL

(71) Applicant: SharkNinja Operating LLC, Needham, MA (US)

(72) Inventor: Damian Howard, Needham, MA (US)

(73) Assignee: SharkNinja Operating LLC, Needham, MA (US)

( * ) Notice: Subject to any disclaimer, the term of this patent is extended or adjusted under 35 U.S.C. 154(b) by 1213 days.

(21) Appl. No.: 17/745,952

(22) Filed: May 17, 2022

(65) Prior Publication Data

US 2023/0371671 A1 Nov. 23, 2023

(51) Int. Cl.
*A45D 20/12* (2006.01)

(52) U.S. Cl.
CPC ..... *A45D 20/12* (2013.01); *A45D 2200/15* (2013.01)

(58) Field of Classification Search
CPC ..... A45D 20/12; A45D 20/30; A45D 20/10; A45D 2200/15; H05B 1/0252
See application file for complete search history.

(56) References Cited

U.S. PATENT DOCUMENTS

| | | | |
|---|---|---|---|
| 6,996,916 | B2 | 2/2006 | Cafaro |
| 7,040,037 | B2 | 5/2006 | Keong |
| 7,661,174 | B2 | 2/2010 | Park |
| 8,066,017 | B1 | 11/2011 | Born et al. |
| 8,146,605 | B1 | 4/2012 | Laaly |
| 8,209,877 | B2 | 7/2012 | Smal |
| 8,407,913 | B2 | 4/2013 | Langley et al. |
| 8,544,477 | B1 | 10/2013 | Laaly |
| 8,602,038 | B2 | 12/2013 | Choi |
| 8,607,470 | B2 | 12/2013 | Richmond et al. |
| 8,607,804 | B2 | 12/2013 | De Benedictis |
| 8,651,118 | B2 | 2/2014 | De Benedictis et al. |
| D715,995 | S | 10/2014 | Dyson et al. |
| D715,996 | S | 10/2014 | Dyson et al. |
| D716,492 | S | 10/2014 | Dyson et al. |

(Continued)

FOREIGN PATENT DOCUMENTS

| | | | |
|---|---|---|---|
| AU | 355723 | S | 5/2014 |
| AU | 2013239504 | A1 | 9/2014 |

(Continued)

OTHER PUBLICATIONS

A Extended European Search Report for EP Patent Application No. 23173987.1 dated Jan. 4, 2024.

*Primary Examiner* — Thien S Tran
(74) *Attorney, Agent, or Firm* — Mintz, Levin, Cohn, Ferris, Glovsky and Popeo, P.C.

(57) ABSTRACT

Various exemplary devices, systems, and methods for phase control heater control are provided. In general, a hair dryer includes a heater configured to heat air for output from the hair dryer. The hair dryer is configured to heat the air with the heater using phase control. The phase control is configured to control the heater to heat the air to a desired temperature (e.g., to a particular desired temperature or within a desired temperature range) while reducing periodic current draw on the hair dryer's AC input. The phase control is configured to control the heater according to predetermined phase angles in an AC power cycle. The methods, systems, and devices for phase control heater control can be used with devices other than hair dryers that use heaters for heat control, such as space heaters.

24 Claims, 6 Drawing Sheets

(56) References Cited

U.S. PATENT DOCUMENTS

D729,447 S 5/2015 Gammack
D729,448 S 5/2015 Gammack
D729,978 S 5/2015 Bates et al.
D729,979 S 5/2015 Gammack
D730,575 S 5/2015 Bates et al.
D730,576 S 5/2015 Gammack
D731,117 S 6/2015 Bates et al.
9,144,286 B2 9/2015 Courtney et al.
D741,544 S 10/2015 Gammack
9,173,468 B2 11/2015 Moloney et al.
9,237,789 B2 1/2016 Prehodka
9,282,799 B2 3/2016 Courtney et al.
9,282,800 B2 3/2016 Courtney et al.
D757,361 S 5/2016 Gammack
D757,362 S 5/2016 Dyson et al.
D758,010 S 5/2016 Bates et al.
D758,011 S 5/2016 Gammack
D758,012 S 5/2016 Bates et al.
9,414,662 B2 8/2016 Moloney et al.
9,420,864 B2 8/2016 Gammack et al.
9,420,865 B2 8/2016 Gammack et al.
9,510,395 B2 11/2016 Coulton et al.
D775,419 S 12/2016 Stephens et al.
9,516,938 B2 12/2016 Richmond et al.
9,526,310 B2 12/2016 Courtney et al.
9,578,943 B2 2/2017 Guy-rabi et al.
9,578,945 B2 2/2017 Han
D782,731 S 3/2017 Smith et al.
D782,732 S 3/2017 Smith et al.
D782,733 S 3/2017 Smith et al.
D782,735 S 3/2017 Stephens et al.
D782,736 S 3/2017 Stephens et al.
9,591,906 B2 3/2017 Guy-Rabi et al.
9,596,916 B2 3/2017 Moloney et al.
9,603,430 B2 3/2017 Seo
D784,614 S 4/2017 Stephens et al.
D785,240 S 4/2017 Smith et al.
D785,241 S 4/2017 Stephens et al.
9,675,157 B2 6/2017 Courtney et al.
9,675,158 B2 6/2017 Soresina et al.
9,687,058 B2 6/2017 Atkinson
D791,407 S 7/2017 Smith et al.
D798,502 S 9/2017 Smith et al.
9,808,065 B2 11/2017 Moloney et al.
9,808,067 B2 11/2017 Sutter et al.
9,877,562 B2 1/2018 Guy-rabi et al.
D811,009 S 2/2018 Smith et al.
9,936,788 B2 4/2018 Stephens et al.
9,936,789 B2 4/2018 Stephens et al.
D817,007 S 5/2018 Guy-rabi et al.
9,986,810 B2 6/2018 Bobillier et al.
10,004,313 B2 6/2018 Atkinson
10,010,150 B2 7/2018 Courtney et al.
10,016,040 B2 7/2018 Courtney et al.
10,021,951 B2 7/2018 Bobillier et al.
10,028,574 B2 7/2018 Rennette
10,064,470 B2 9/2018 Warne
10,076,172 B2 9/2018 Stephens et al.
10,080,414 B2 9/2018 Douglas et al.
D830,630 S 10/2018 Chia et al.
10,085,537 B2 10/2018 Maclaine
10,085,538 B2 10/2018 Saunders et al.
10,117,491 B2 11/2018 Moloney et al.
10,143,285 B2 12/2018 Stephens et al.
10,165,843 B2 1/2019 Hedges
10,165,844 B2 1/2019 Stephens et al.
10,186,822 B2 1/2019 Hogan
10,194,728 B2 2/2019 Stephens et al.
10,213,001 B2 2/2019 Stephens et al.
D843,652 S 3/2019 Mcluckie et al.
D843,653 S 3/2019 Teyu et al.
D843,654 S 3/2019 Teyu et al.
10,226,112 B2 3/2019 Kerr et al.
10,238,199 B2 3/2019 Stephens et al.
D847,421 S 4/2019 Tappenden et al.
D847,422 S 4/2019 Tappenden et al.
D847,423 S 4/2019 Tappenden et al.
D847,424 S 4/2019 Tappenden et al.
D847,425 S 4/2019 Tappenden et al.
D847,426 S 4/2019 Tappenden et al.
D848,063 S 5/2019 Tappenden et al.
D848,064 S 5/2019 Tappenden et al.
D848,065 S 5/2019 Heffer et al.
D848,066 S 5/2019 Coulton et al.
D848,067 S 5/2019 Heffer et al.
D848,068 S 5/2019 Heffer et al.
D848,675 S 5/2019 Chia et al.
D850,001 S 5/2019 Coulton et al.
10,278,471 B2 5/2019 Shelton et al.
D852,415 S 6/2019 Coulton et al.
D852,416 S 6/2019 Coulton et al.
10,306,965 B2 6/2019 Wilkinson et al.
D853,637 S 7/2019 Coulton et al.
D853,638 S 7/2019 Tappenden et al.
D853,639 S 7/2019 Tappenden et al.
D853,640 S 7/2019 Tappenden et al.
D853,641 S 7/2019 Tappenden et al.
D853,642 S 7/2019 Coulton et al.
D854,745 S 7/2019 Chia et al.
D855,252 S 7/2019 Coulton et al.
D856,579 S 8/2019 Chia et al.
D856,580 S 8/2019 Chia et al.
10,383,422 B2 8/2019 Law et al.
10,390,599 B1 8/2019 James et al.
D860,528 S 9/2019 Atkinson et al.
D860,529 S 9/2019 Atkinson et al.
D860,530 S 9/2019 Atkinson et al.
D860,531 S 9/2019 Atkinson et al.
D860,532 S 9/2019 Atkinson et al.
D865,286 S 10/2019 Atkinson et al.
10,441,049 B2 10/2019 Douglas et al.
10,441,050 B2 10/2019 Blanc et al.
10,448,722 B2 10/2019 Mcluckie
10,470,545 B2 11/2019 Thiebaut et al.
D869,763 S 12/2019 Atkinson et al.
D869,764 S 12/2019 Atkinson et al.
10,575,617 B2 3/2020 Courtney et al.
10,582,751 B2 3/2020 Courtney
10,602,826 B2 3/2020 Wilkinson et al.
10,610,000 B2 4/2020 Courtney et al.
D884,966 S 5/2020 Flynn et al.
D885,663 S 5/2020 Flynn et al.
10,660,417 B2 5/2020 Bennett
10,660,418 B2 5/2020 Degrood et al.
10,687,595 B2 6/2020 Courtney et al.
10,729,218 B2 8/2020 Childe et al.
10,765,191 B2 9/2020 Stephens et al.
10,786,061 B2 9/2020 Thiebaut et al.
10,869,529 B2 12/2020 Chia et al.
10,874,186 B2 12/2020 Macpherson et al.
D923,874 S 6/2021 Kirkbride et al.
11,033,088 B2 6/2021 Atkinson et al.
11,044,979 B2 6/2021 Maclaine
11,071,365 B2 7/2021 Maclaine et al.
11,168,924 B2 11/2021 Naicker et al.
11,172,745 B2 11/2021 Tam et al.
2008/0116753 A1 5/2008 Carlucci
2013/0111777 A1 5/2013 Jeong
2013/0233336 A1 9/2013 Lazzaro et al.
2015/0089828 A1 4/2015 Moloney et al.
2016/0037888 A1 2/2016 Richmond et al.
2016/0262518 A1 9/2016 Guy-rabi et al.
2017/0150796 A1 6/2017 Stephens et al.
2017/0150797 A1 6/2017 Imhasly et al.
2017/0150798 A1 6/2017 Bobillier et al.
2017/0164709 A1* 6/2017 Laveni ..... A45D 20/10
2017/0231358 A1 8/2017 Jeong
2017/0273428 A1 9/2017 Nicolson et al.
2017/0273429 A1 9/2017 Nicolson et al.
2017/0310249 A1 10/2017 Zheng et al.
2018/0055182 A1 3/2018 Thompson et al.
2019/0223572 A1 7/2019 Ahrens
2019/0357653 A1 11/2019 Guerreiro et al.
2019/0380463 A1 12/2019 Guerreiro et al.

(56) References Cited

U.S. PATENT DOCUMENTS

| | | | |
|---|---|---|---|
| 2020/0037725 | A1 | 2/2020 | Ahrens |
| 2020/0085161 | A1 | 3/2020 | James et al. |
| 2020/0085163 | A1 | 3/2020 | James et al. |
| 2020/0237070 | A1 | 7/2020 | Degrood et al. |
| 2020/0397111 | A1 | 12/2020 | Bouchar |
| 2021/0251362 | A1 | 8/2021 | Loke et al. |
| 2021/0285328 | A1 | 9/2021 | Mahmoodilari et al. |
| 2021/0381527 | A1 | 12/2021 | Peet et al. |

FOREIGN PATENT DOCUMENTS

| | | | |
|---|---|---|---|
| AU | 2013239510 | A1 | 9/2014 |
| AU | 2013285200 | A1 | 1/2015 |
| AU | 2013285201 | A1 | 1/2015 |
| AU | 2013239504 | B2 | 4/2015 |
| AU | 2013239510 | B2 | 10/2015 |
| AU | 2013285200 | B2 | 11/2015 |
| AU | 365799 | S | 12/2015 |
| AU | 365800 | S | 12/2015 |
| AU | 365855 | S | 12/2015 |
| AU | 2014285903 | A1 | 12/2015 |
| AU | 366597 | S | 1/2016 |
| AU | 2013285201 | B2 | 1/2016 |
| AU | 367865 | S | 3/2016 |
| AU | 367880 | S | 3/2016 |
| AU | 2014389903 | A1 | 9/2016 |
| AU | 2015233175 | A1 | 9/2016 |
| AU | 2014285903 | B2 | 2/2017 |
| AU | 2014285903 | C1 | 5/2017 |
| AU | 2015233175 | B2 | 9/2017 |
| AU | 2017101822 | A4 | 2/2018 |
| AU | 2018201042 | A1 | 3/2018 |
| AU | 2017318546 | A1 | 2/2019 |
| AU | 2018201042 | B2 | 8/2019 |
| AU | 2017318546 | B2 | 7/2020 |
| CA | 2873465 | A1 | 11/2013 |
| CA | 155600 | S | 10/2014 |
| CA | 155601 | S | 10/2014 |
| CA | 155602 | S | 10/2014 |
| CA | 2943399 | A1 | 9/2015 |
| CA | 2943400 | A1 | 9/2015 |
| CA | 2943401 | A1 | 9/2015 |
| CA | 2788103 | C | 3/2016 |
| CA | 165648 | S | 6/2016 |
| CA | 165649 | S | 6/2016 |
| CA | 165650 | S | 6/2016 |
| CA | 163169 | S | 12/2016 |
| CA | 163170 | S | 12/2016 |
| CA | 163184 | S | 12/2016 |
| CA | 166089 | S | 12/2016 |
| CA | 166228 | S | 12/2016 |
| CA | 166229 | S | 12/2016 |
| CA | 3035152 | A1 | 3/2018 |
| CA | 177161 | S | 5/2018 |
| CA | 176864 | S | 6/2018 |
| CA | 179968 | S | 1/2019 |
| CA | 179969 | S | 1/2019 |
| CA | 178448 | S | 12/2019 |
| CA | 178449 | S | 12/2019 |
| CA | 178450 | S | 12/2019 |
| CA | 178451 | S | 12/2019 |
| CA | 178452 | S | 12/2019 |
| CA | 178454 | S | 12/2019 |
| CA | 178457 | S | 12/2019 |
| CA | 178458 | S | 12/2019 |
| CA | 178459 | S | 12/2019 |
| CA | 3109771 | A1 | 3/2020 |
| CN | 203168302 | U | 9/2013 |
| CN | 203168303 | U | 9/2013 |
| CN | 203220053 | U | 10/2013 |
| CN | 203328162 | U | 12/2013 |
| CN | 203369521 | U | 1/2014 |
| CN | 203369522 | U | 1/2014 |
| CN | 204292438 | U | 4/2015 |
| CN | 204317818 | U | 5/2015 |
| CN | 204483371 | U | 7/2015 |
| CN | 204483372 | U | 7/2015 |
| CN | 204483373 | U | 7/2015 |
| CN | 204499778 | U | 7/2015 |
| CN | 104921436 | A | 9/2015 |
| CN | 104921437 | A | 9/2015 |
| CN | 204742992 | U | 11/2015 |
| CN | 204796991 | U | 11/2015 |
| CN | 204796992 | U | 11/2015 |
| CN | 105231630 | A | 1/2016 |
| CN | 103355925 | B | 2/2016 |
| CN | 105433576 | A | 3/2016 |
| CN | 102665479 | B | 7/2016 |
| CN | 103355930 | B | 8/2016 |
| CN | 103519541 | B | 8/2016 |
| CN | 205456831 | U | 8/2016 |
| CN | 106256286 | A | 12/2016 |
| CN | 103355927 | B | 3/2017 |
| CN | 205993856 | U | 3/2017 |
| CN | 206043777 | U | 3/2017 |
| CN | 206043778 | U | 3/2017 |
| CN | 206043779 | U | 3/2017 |
| CN | 103355926 | B | 4/2017 |
| CN | 103355928 | B | 4/2017 |
| CN | 103355929 | B | 4/2017 |
| CN | 103519540 | B | 4/2017 |
| CN | 206150740 | U | 5/2017 |
| CN | 107224080 | A | 10/2017 |
| CN | 206651501 | U | 11/2017 |
| CN | 206699677 | U | 12/2017 |
| CN | 206744836 | U | 12/2017 |
| CN | 104337192 | B | 1/2018 |
| CN | 207023591 | U | 2/2018 |
| CN | 207023592 | U | 2/2018 |
| CN | 207168088 | U | 4/2018 |
| CN | 207322932 | U | 5/2018 |
| CN | 207322933 | U | 5/2018 |
| CN | 207355685 | U | 5/2018 |
| CN | 207544575 | U | 6/2018 |
| CN | 207544576 | U | 6/2018 |
| CN | 108402637 | A | 8/2018 |
| CN | 207767746 | U | 8/2018 |
| CN | 108567216 | A | 9/2018 |
| CN | 207803715 | U | 9/2018 |
| CN | 104273917 | B | 10/2018 |
| CN | 104273919 | B | 10/2018 |
| CN | 104510138 | B | 10/2018 |
| CN | 207939324 | U | 10/2018 |
| CN | 208144696 | U | 11/2018 |
| CN | 208144697 | U | 11/2018 |
| CN | 105392386 | B | 12/2018 |
| CN | 108991700 | A | 12/2018 |
| CN | 208339134 | U | 1/2019 |
| CN | 104273918 | B | 2/2019 |
| CN | 208524016 | U | 2/2019 |
| CN | 109497683 | A | 3/2019 |
| CN | 105559311 | B | 4/2019 |
| CN | 209073632 | U | 7/2019 |
| CN | 104921435 | B | 8/2019 |
| CN | 106256287 | B | 8/2019 |
| CN | 110074535 | A | 8/2019 |
| CN | 106333459 | B | 9/2019 |
| CN | 209573664 | U | 11/2019 |
| CN | 105473022 | B | 2/2020 |
| CN | 210055005 | U | 2/2020 |
| CN | 210055006 | U | 2/2020 |
| CN | 106256282 | B | 3/2020 |
| CN | 111140550 | A | 5/2020 |
| CN | 111140551 | A | 5/2020 |
| CN | 111202335 | A | 5/2020 |
| CN | 111248594 | A | 6/2020 |
| CN | 111432684 | A | 7/2020 |
| CN | 106820534 | B | 8/2020 |
| CN | 211154233 | U | 8/2020 |
| CN | 105407757 | B | 10/2020 |
| CN | 106880155 | B | 10/2020 |
| CN | 106974416 | B | 10/2020 |
| CN | 211820129 | U | 10/2020 |
| CN | 106974415 | B | 11/2020 |

(56) References Cited

FOREIGN PATENT DOCUMENTS

| | | | | |
|---|---|---|---|---|
| CN | 107847031 | B | | 11/2020 |
| CN | 108206600 | B | | 11/2020 |
| CN | 211984215 | U | | 11/2020 |
| CN | 211984221 | U | | 11/2020 |
| CN | 212185556 | U | | 12/2020 |
| CN | 112336037 | A | | 2/2021 |
| CN | 112352109 | A | | 2/2021 |
| CN | 108618334 | B | | 4/2021 |
| CN | 106963093 | B | | 5/2021 |
| CN | 108618333 | B | | 5/2021 |
| CN | 213096652 | U | | 5/2021 |
| CN | 213215774 | U | | 5/2021 |
| CN | 213244680 | U | * | 5/2021 |
| CN | 106165959 | B | | 6/2021 |
| CN | 107224085 | B | | 6/2021 |
| CN | 107317521 | B | | 6/2021 |
| CN | 106256284 | B | | 7/2021 |
| CN | 113080592 | A | | 7/2021 |
| CN | 105407756 | B | | 8/2021 |
| CN | 106901482 | B | | 8/2021 |
| CN | 107224087 | B | | 8/2021 |
| CN | 107224077 | B | | 9/2021 |
| CN | 113437901 | A | | 9/2021 |
| CN | 109788833 | B | | 11/2021 |
| CN | 109674176 | B | | 3/2022 |
| DE | 19722162 | A1 | | 12/1997 |
| DE | 102012220756 | B4 | | 2/2017 |
| DE | 202014011043 | U1 | | 7/2017 |
| EP | 1334670 | B1 | | 12/2004 |
| EP | 1779745 | B1 | | 5/2008 |
| EP | 2745729 | B1 | | 11/2015 |
| EP | 2656746 | B1 | | 12/2015 |
| EP | 3119235 | A1 | | 1/2017 |
| EP | 3119236 | A1 | | 1/2017 |
| EP | 2830462 | B1 | | 6/2018 |
| EP | 3016545 | B1 | | 6/2018 |
| EP | 3158890 | B1 | | 8/2018 |
| EP | 3024352 | B1 | | 10/2018 |
| EP | 3386343 | A1 | | 10/2018 |
| EP | 3206523 | B1 | | 12/2018 |
| EP | 3016541 | B1 | | 1/2019 |
| EP | 3235397 | B1 | | 2/2019 |
| EP | 3310207 | B1 | | 2/2019 |
| EP | 3172985 | B1 | | 4/2019 |
| EP | 3232853 | B1 | | 4/2019 |
| EP | 3016540 | B1 | | 5/2019 |
| EP | 3048926 | B1 | | 6/2019 |
| EP | 3048925 | B1 | | 7/2019 |
| EP | 3506786 | A1 | | 7/2019 |
| EP | 3512372 | A1 | | 7/2019 |
| EP | 3516986 | A1 | | 7/2019 |
| EP | 3364816 | B1 | | 10/2019 |
| EP | 2830457 | B1 | | 12/2019 |
| EP | 2830459 | B1 | | 12/2019 |
| EP | 3622780 | A1 | | 3/2020 |
| EP | 2869726 | B1 | | 4/2020 |
| EP | 2869727 | B1 | | 4/2020 |
| EP | 3432759 | B1 | | 6/2020 |
| EP | 3016544 | B1 | | 7/2020 |
| EP | 3310204 | B1 | | 7/2020 |
| EP | 3687335 | A1 | | 8/2020 |
| EP | 3328237 | B1 | | 11/2020 |
| EP | 3319473 | B1 | | 2/2021 |
| EP | 3432757 | B1 | | 2/2021 |
| EP | 3834654 | A1 | | 6/2021 |
| EP | 3874171 | A1 | | 9/2021 |
| EP | 3119234 | B1 | | 11/2021 |
| ES | 2233765 | T3 | | 6/2005 |
| ES | 2559438 | T3 | | 2/2016 |
| ES | 2683041 | T3 | | 9/2018 |
| ES | 2696900 | T3 | | 1/2019 |
| ES | 2703203 | T3 | | 3/2019 |
| ES | 2704856 | T3 | | 3/2019 |
| ES | 2721185 | T3 | | 7/2019 |
| ES | 2730412 | T3 | | 11/2019 |
| ES | 2732428 | T3 | | 11/2019 |
| ES | 2741441 | T3 | | 2/2020 |
| ES | 2837131 | T3 | | 6/2021 |
| FR | 3039377 | B1 | | 9/2017 |
| GB | 2501175 | B | | 4/2014 |
| GB | 2500798 | B | | 5/2014 |
| GB | 2500800 | B | | 5/2014 |
| GB | 2501379 | B | | 5/2014 |
| GB | 2500801 | B | | 7/2014 |
| GB | 2511219 | B | | 5/2015 |
| GB | 2515809 | B | | 8/2015 |
| GB | 2515810 | B | | 11/2015 |
| GB | 2515811 | B | | 11/2015 |
| GB | 2515812 | B | | 2/2016 |
| GB | 2516478 | B | | 3/2016 |
| GB | 2518639 | B | | 3/2016 |
| GB | 2531431 | B | | 11/2016 |
| GB | 2521144 | B | | 12/2016 |
| GB | 2526768 | B | | 2/2017 |
| GB | 2503683 | B | | 4/2017 |
| GB | 2524304 | B | | 4/2017 |
| GB | 2526049 | B | | 4/2017 |
| GB | 2515813 | B | | 7/2017 |
| GB | 2548813 | A | | 10/2017 |
| GB | 2548817 | A | | 10/2017 |
| GB | 2533324 | B | | 12/2017 |
| GB | 2552445 | A | | 1/2018 |
| GB | 2503687 | B | | 2/2018 |
| GB | 2547138 | B | | 3/2018 |
| GB | 2534379 | B | | 5/2018 |
| GB | 2539439 | B | | 5/2018 |
| GB | 2545412 | B | | 6/2018 |
| GB | 2539437 | B | | 7/2018 |
| GB | 2540203 | B | | 7/2018 |
| GB | 2551852 | B | | 9/2018 |
| GB | 2539432 | B | | 1/2019 |
| GB | 2539441 | B | | 1/2019 |
| GB | 2543536 | B | | 1/2019 |
| GB | 2558415 | B | | 2/2019 |
| GB | 2543751 | B | | 4/2019 |
| GB | 2549740 | B | | 4/2019 |
| GB | 2538560 | B | | 5/2019 |
| GB | 2548816 | B | | 9/2019 |
| GB | 2548812 | B | | 10/2019 |
| GB | 2553516 | B | | 1/2020 |
| GB | 2565698 | B | | 1/2020 |
| GB | 2548616 | B | | 2/2020 |
| GB | 2560888 | B | | 4/2020 |
| GB | 2548819 | B | | 5/2020 |
| GB | 2557958 | B | | 5/2020 |
| GB | 2580416 | A | | 7/2020 |
| GB | 2560889 | B | | 9/2020 |
| GB | 2567661 | B | | 9/2020 |
| GB | 2562276 | B | | 4/2021 |
| GB | 2576017 | B | | 4/2021 |
| GB | 2575297 | B | | 5/2021 |
| GB | 2581371 | B | | 9/2021 |
| GB | 2581372 | B | | 12/2021 |
| GB | 2606228 | A | * | 11/2022 ..... H03K 17/72 |
| IL | 236277 | A | | 5/2018 |
| JP | 2013212383 | A | | 10/2013 |
| JP | 2013212385 | A | | 10/2013 |
| JP | 2013212387 | A | | 10/2013 |
| JP | 2013212388 | A | | 10/2013 |
| JP | 2014012142 | A | | 1/2014 |
| JP | 2014012143 | A | | 1/2014 |
| JP | 2014217770 | A | | 11/2014 |
| JP | 5674852 | B2 | | 1/2015 |
| JP | 2015013124 | A | | 1/2015 |
| JP | 2015013125 | A | | 1/2015 |
| JP | 2015013127 | A | | 1/2015 |
| JP | 2015023798 | A | | 2/2015 |
| JP | 2015024137 | A | | 2/2015 |
| JP | 5709926 | B2 | | 3/2015 |
| JP | 2015066446 | A | | 4/2015 |
| JP | 2015066447 | A | | 4/2015 |
| JP | 2015097941 | A | | 5/2015 |
| JP | 5758944 | B2 | | 6/2015 |
| JP | 5760030 | B2 | | 6/2015 |

(56) References Cited

FOREIGN PATENT DOCUMENTS

| | | | |
|---|---|---|---|
| JP | 2015181946 | A | 10/2015 |
| JP | 2015181947 | A | 10/2015 |
| JP | 2016040008 | A | 3/2016 |
| JP | 5913465 | B2 | 4/2016 |
| JP | 5923062 | B2 | 4/2016 |
| JP | 2016083586 | A | 5/2016 |
| JP | 5953642 | B2 | 6/2016 |
| JP | 2016112424 | A | 6/2016 |
| JP | 2016129688 | A | 7/2016 |
| JP | 2016129780 | A | 7/2016 |
| JP | 2016131890 | A | 7/2016 |
| JP | 5990839 | B2 | 8/2016 |
| JP | 2016523648 | A | 8/2016 |
| JP | 6008302 | B2 | 9/2016 |
| JP | 2016526429 | A | 9/2016 |
| JP | 6035635 | B2 | 11/2016 |
| JP | 2016214879 | A | 12/2016 |
| JP | 2017006664 | A | 1/2017 |
| JP | 2017006665 | A | 1/2017 |
| JP | 2017006666 | A | 1/2017 |
| JP | 2017006668 | A | 1/2017 |
| JP | 2017006669 | A | 1/2017 |
| JP | 2017018593 | A | 1/2017 |
| JP | 6085841 | B2 | 2/2017 |
| JP | 2017077470 | A | 4/2017 |
| JP | 2017077471 | A | 4/2017 |
| JP | 2017077472 | A | 4/2017 |
| JP | 2017079592 | A | 4/2017 |
| JP | 2017512589 | A | 5/2017 |
| JP | 6161762 | B2 | 6/2017 |
| JP | 2017094095 | A | 6/2017 |
| JP | 2017094096 | A | 6/2017 |
| JP | 2017140364 | A | 8/2017 |
| JP | 6208265 | B2 | 9/2017 |
| JP | 2017170147 | A | 9/2017 |
| JP | 2017170149 | A | 9/2017 |
| JP | 2017170150 | A | 9/2017 |
| JP | 2017185217 | A | 10/2017 |
| JP | 2017200432 | A | 11/2017 |
| JP | 6278854 | B2 | 1/2018 |
| JP | 6291523 | B2 | 2/2018 |
| JP | 6297958 | B2 | 3/2018 |
| JP | 2018033968 | A | 3/2018 |
| JP | 6332918 | B2 | 5/2018 |
| JP | 6343633 | B2 | 5/2018 |
| JP | 6344570 | B2 | 6/2018 |
| JP | 2018086277 | A | 6/2018 |
| JP | 1608559 | S | 7/2018 |
| JP | 2018110514 | A | 7/2018 |
| JP | 1611708 | S | 8/2018 |
| JP | 6386547 | B2 | 8/2018 |
| JP | 1614531 | S | 9/2018 |
| JP | 6416155 | B2 | 10/2018 |
| JP | 6416173 | B2 | 10/2018 |
| JP | 2018158110 | A | 10/2018 |
| JP | 2018158111 | A | 10/2018 |
| JP | 1617402 | S | 11/2018 |
| JP | 1618289 | S | 11/2018 |
| JP | 1618303 | S | 11/2018 |
| JP | 1618610 | S | 11/2018 |
| JP | 6434452 | B2 | 11/2018 |
| JP | 2018190728 | A | 11/2018 |
| JP | 1620038 | S | 12/2018 |
| JP | 6444361 | B2 | 12/2018 |
| JP | 6453814 | B2 | 12/2018 |
| JP | 6453829 | B2 | 12/2018 |
| JP | 6456879 | B2 | 12/2018 |
| JP | 6475261 | B2 | 2/2019 |
| JP | 1625926 | S | 3/2019 |
| JP | 6511080 | B2 | 4/2019 |
| JP | 6512713 | B2 | 4/2019 |
| JP | 6518281 | B2 | 4/2019 |
| JP | 6522914 | B2 | 5/2019 |
| JP | 6523157 | B2 | 5/2019 |
| JP | 6533480 | B2 | 5/2019 |
| JP | 2019076720 | A | 5/2019 |
| JP | 6538010 | B2 | 6/2019 |
| JP | 6542180 | B2 | 6/2019 |
| JP | 1637643 | S | 7/2019 |
| JP | 6556183 | B2 | 7/2019 |
| JP | 6557650 | B2 | 7/2019 |
| JP | 6557695 | B2 | 7/2019 |
| JP | 6599917 | B2 | 10/2019 |
| JP | 2019193568 | A | 10/2019 |
| JP | 6625527 | B2 | 12/2019 |
| JP | 6634296 | B2 | 12/2019 |
| JP | 6662936 | B2 | 2/2020 |
| JP | 3225772 | U | 3/2020 |
| JP | 2020047605 | A | 3/2020 |
| JP | 3226032 | U | 4/2020 |
| JP | 6723287 | B2 | 6/2020 |
| JP | 6723961 | B2 | 6/2020 |
| JP | 6738839 | B2 | 7/2020 |
| JP | 6779198 | B2 | 10/2020 |
| JP | 6792318 | B2 | 11/2020 |
| JP | 6811290 | B2 | 12/2020 |
| JP | 6854109 | B2 | 3/2021 |
| JP | 6861790 | B2 | 4/2021 |
| JP | 6890571 | B2 | 5/2021 |
| JP | 6924442 | B2 | 8/2021 |
| KR | 20140129309 | A | 11/2014 |
| KR | 20140129310 | A | 11/2014 |
| KR | 20140129322 | A | 11/2014 |
| KR | 20140129323 | A | 11/2014 |
| KR | 20140129324 | A | 11/2014 |
| KR | 20140138797 | A | 12/2014 |
| KR | 20150023773 | A | 3/2015 |
| KR | 20150023774 | A | 3/2015 |
| KR | 20160020555 | A | 2/2016 |
| KR | 20160020556 | A | 2/2016 |
| KR | 20160020557 | A | 2/2016 |
| KR | 20160020558 | A | 2/2016 |
| KR | 20160021265 | A | 2/2016 |
| KR | 20160021294 | A | 2/2016 |
| KR | 20160021862 | A | 2/2016 |
| KR | 20160052719 | A | 5/2016 |
| KR | 20160052720 | A | 5/2016 |
| KR | 20160052721 | A | 5/2016 |
| KR | 20160075829 | A | 6/2016 |
| KR | 20160075831 | A | 6/2016 |
| KR | 20160079142 | A | 7/2016 |
| KR | 20160079144 | A | 7/2016 |
| KR | 20160079146 | A | 7/2016 |
| KR | 101660347 | B1 | 9/2016 |
| KR | 20160126073 | A | 11/2016 |
| KR | 20160126074 | A | 11/2016 |
| KR | 20160004256 | U | 12/2016 |
| KR | 101693281 | B1 | 1/2017 |
| KR | 20170001743 | A | 1/2017 |
| KR | 101713997 | B1 | 3/2017 |
| KR | 101726280 | B1 | 4/2017 |
| KR | 20170001222 | U | 4/2017 |
| KR | 101761297 | B1 | 7/2017 |
| KR | 20170084313 | A | 7/2017 |
| KR | 101771206 | B1 | 8/2017 |
| KR | 20170105100 | A | 9/2017 |
| KR | 20170139700 | A | 12/2017 |
| KR | 20180010248 | A | 1/2018 |
| KR | 20180017193 | A | 2/2018 |
| KR | 20180017194 | A | 2/2018 |
| KR | 20180017196 | A | 2/2018 |
| KR | 20180017197 | A | 2/2018 |
| KR | 20180030620 | A | 3/2018 |
| KR | 101844912 | B1 | 4/2018 |
| KR | 20180033312 | A | 4/2018 |
| KR | 101855222 | B1 | 5/2018 |
| KR | 101855223 | B1 | 5/2018 |
| KR | 20180069051 | A | 6/2018 |
| KR | 20180069894 | A | 6/2018 |
| KR | 20180071986 | A | 6/2018 |
| KR | 20180072754 | A | 6/2018 |
| KR | 20180086444 | A | 7/2018 |
| KR | 101900840 | B1 | 9/2018 |
| KR | 20180105275 | A | 9/2018 |

(56) References Cited

FOREIGN PATENT DOCUMENTS

| | | | | |
|---|---|---|---|---|
| KR | 101909949 | B1 | 10/2018 | |
| KR | 20180110243 | A | 10/2018 | |
| KR | 101921159 | B1 | 11/2018 | |
| KR | 20180003187 | U | 11/2018 | |
| KR | 20180003188 | U | 11/2018 | |
| KR | 20180003197 | U | 11/2018 | |
| KR | 20180120253 | A | 11/2018 | |
| KR | 20180120254 | A | 11/2018 | |
| KR | 20180120815 | A | 11/2018 | |
| KR | 20180121607 | A | 11/2018 | |
| KR | 20180121984 | A | 11/2018 | |
| KR | 20180124165 | A | 11/2018 | |
| KR | 20180128480 | A | 12/2018 | |
| KR | 101946431 | B1 | 2/2019 | |
| KR | 101949900 | B1 | 2/2019 | |
| KR | 20190017075 | A | 2/2019 | |
| KR | 101953713 | B1 | 3/2019 | |
| KR | 101963674 | B1 | 3/2019 | |
| KR | 101964103 | B1 | 4/2019 | |
| KR | 101965272 | B1 | 4/2019 | |
| KR | 20190037328 | A | 4/2019 | |
| KR | 101953711 | B1 | 5/2019 | |
| KR | 101978707 | B1 | 5/2019 | |
| KR | 101983111 | B1 | 5/2019 | |
| KR | 20190001036 | U | 5/2019 | |
| KR | 101990944 | B1 | 6/2019 | |
| KR | 101992734 | B1 | 6/2019 | |
| KR | 102007214 | B1 | 8/2019 | |
| KR | 102007215 | B1 | 8/2019 | |
| KR | 200489784 | Y1 | 8/2019 | |
| KR | 102018622 | B1 | 9/2019 | |
| KR | 102018623 | B1 | 9/2019 | |
| KR | 102010940 | B1 | 10/2019 | |
| KR | 102030102 | B1 | 10/2019 | |
| KR | 102030103 | B1 | 10/2019 | |
| KR | 102031600 | B1 | 10/2019 | |
| KR | 20190122864 | A | 10/2019 | |
| KR | 102041173 | B1 | 11/2019 | |
| KR | 20190126159 | A | 11/2019 | |
| KR | 20190141227 | A | 12/2019 | |
| KR | 200490784 | Y1 | 1/2020 | |
| KR | 102074285 | B1 | 2/2020 | |
| KR | 200491247 | Y1 | 3/2020 | |
| KR | 102101642 | B1 | 4/2020 | |
| KR | 102101643 | B1 | 4/2020 | |
| KR | 102102243 | B1 | 4/2020 | |
| KR | 102121904 | B1 | 6/2020 | |
| KR | 20200068710 | A | 6/2020 | |
| KR | 102158115 | B1 | 9/2020 | |
| KR | 102175883 | B1 | 11/2020 | |
| KR | 102210212 | B1 | 1/2021 | |
| KR | 20210012063 | A | 2/2021 | |
| KR | 102328006 | B1 | 11/2021 | |
| TW | M494533 | U | 2/2015 | |
| WO | WO-2021129543 | A1 * | 7/2021 | ..... A45D 20/12 |
| WO | 2022069857 | A1 | 4/2022 | |
| WO | 2022069858 | A1 | 4/2022 | |
| WO | 2022069859 | A1 | 4/2022 | |
| WO | 2022069860 | A1 | 4/2022 | |
| WO | 2022069864 | A1 | 4/2022 | |
| WO | 2022069865 | A1 | 4/2022 | |
| WO | 2022069881 | A1 | 4/2022 | |

* cited by examiner

PHASE CONTROL HEATER CONTROL

FIELD

The present disclosure generally relates to phase control heater control.

BACKGROUND

Hair dryers provide a flow of air that a user can utilize to dry wet hair. In many instances, the hair dryer also heats and/or ionizes the air prior to the air exiting the hair dryer. Hair dryers are generally powered via alternating current (AC) and generally include an outlet that includes an opening with fixed dimensions where the heated air is expelled from the device. For best hair drying performance, hair dryers may incorporate a microprocessor that monitors resistance change of a negative temperature coefficient (NTC) thermistor mounted close to the opening where heated air is expelled. The hair dryer's heaters can then be controlled by the microcontroller so as to vary their heat output. This "feedback loop" enables the hair dryer to achieve a controlled output temperature of the heated air that is optimal for hair drying. However, it can be challenging to maintain a desired temperature of the heated air without one or more disadvantageous effects. For example, turning the hair dryer's heaters on and off across multiple AC cycles to control the hair dryer's heaters can cause periodic current draw on the AC input. In older homes (or other sites of hair dryer use) or in homes (or other sites of hair dryer use) with less ideal electrical wiring, the periodic current draw can cause light flickering, a circuit breaker trip, and/or appliance (e.g., microwave, fan, etc.) power fluctuation when the hair dryer is used in close vicinity or on the same "branch" circuit as the light or appliance. Vanity lights and nearby outlets to which the hair dryer is plugged into are typically particularly susceptible to such flickering and power fluctuation. A filter on the AC input line may reduce adverse effects of the periodic current draw, but the filter is traditionally too large to fit within a hair dryer's handle or nozzle and thus results in an aesthetically unappealing, bulky box, such as an electromagnetic compatibility (EMC) box, on the hair dryer's cord. Similar problems can exist with other AC-powered devices that maintain temperature using heaters, such as space heaters.

Accordingly, there remains a need for improved devices, systems, and methods for heater control.

SUMMARY

In general, devices, systems, and methods for phase control heater control are provided.

In one aspect, an apparatus is provided that in one embodiment includes a first heating element configured to heat air to be output from a device powered with alternating current (AC) power, and a processor configured to, based on a phase angle of the AC power and based on which one of a plurality of stages the device is operating in, control turning on and off the first heating element and control turning on and off the second heating element.

The apparatus can vary in any number of ways. For example, each of the plurality of stages can correspond to a predetermined phase angle of the AC power at which the first heating element is turned on to heat the air to be output from the device. In some embodiments, a dead zone can be in each 360° cycle of the AC power such that none of the predetermined phase angles are in the dead zone. In some embodiments, the apparatus also includes a temperature sensor configured to measure a temperature of the air to be output from the device, the processor can be configured to increase the stage by one if the measured temperature is below a predetermined desired temperature, and the processor can be configured to decrease the stage by one if the measured temperature is above the predetermined desired temperature. The apparatus can also include a heat control configured to allow a user to set the predetermined desired temperature.

For another example, the apparatus can also include a second heating element configured to heat the air to be output from the device, and the processor can be configured to, based on the phase angle of the AC power and based on which one of the plurality of stages the device is operating in, control turning on and off the second heating elements. In some embodiments, each of the plurality of stages can correspond to a first predetermined phase angle of the AC power at which one of the first and second heating elements is turned on to heat the air to be output from the device and can correspond to a second predetermined angle phase of the AC power at which the other of the first and second heating elements is turned on to heat the air to be output from the device. In some embodiments, alternate ones of the stages can apply the first predetermined phase angle to the first heating element and the second predetermined phase angle to the second heating element with intervening ones of the stages applying the second predetermined phase angle to the first heating element and the first predetermined phase angle to the second heating element. The apparatus can also include a first heater triode for alternating current (triac) operatively coupled to the first heating element and the processor, can also include a second heater triac operatively coupled to the second heating element and the processor, and the processor can be configured to control the first heating element via the first triac and to control the second heating element via the second triac. The apparatus can also include a temperature sensor configured to measure a temperature of the air to be output from the device, the processor can be configured to increase the stage by one if the measured temperature is below a predetermined desired temperature, and the processor can be configured to decrease the stage by one if the measured temperature is above the predetermined desired temperature. The apparatus can also include a heat control configured to allow a user to set the predetermined desired temperature.

For still another example, the processor can be configured to change the stage of the device only once per 360° cycle of the AC power.

For yet another example, each of the stages can correspond to a power level of the device ranging from 0% power to 100% power.

For still another example, the apparatus can also include a circuit configured to filter the AC power input to the device prior to the processor receiving the input AC power. In some embodiments, the circuit can include an inductor and two capacitors.

For yet another example, a dead zone can be in each 360° cycle of the AC power such that none of the predetermined phase angles are in the dead zone.

For another example, the device can be a hair dryer configured to output the heated air, and the first heating element and the heat control circuit can each be disposed in a handle of the hair dryer. In some embodiments, the apparatus can also include a housing of the hair dryer and a power cable extending from the housing configured to operatively couple to an AC source, and the handle can extend from the housing. In some embodiments, the apparatus can also include a filter circuit disposed in the handle and configured to filter the AC power input to the hair dryer prior to the processor receiving the input AC power, and the filter circuit can include an inductor and two capacitors.

For still another example, the apparatus can also include a first heater triode for alternating current (triac) operatively coupled to the first heating element and the processor, and the processor can be configured to control the first heating element via the first triac.

For another example, the apparatus can also include a non-transitory computer-readable storage medium storing an algorithm configured to be executed by the processor to control the turning on and off the first heating element.

In another embodiment, an apparatus includes a first heating element configured to heat air to be output from a hair dryer powered with AC power, a temperature sensor configured to measure a temperature of the air to be output from the hair dryer, and a processor communicatively coupled to the first and second heating elements and configured to identify which one of a plurality of stages the hair dryer is operating in, each of the plurality of stages corresponding to a first predetermined phase angle of the AC power at which the processor is configured to turn on the first element, and change the stage the hair dryer is operating in based on whether the measured temperature satisfies a predetermined desired temperature.

The apparatus can have any number of variations. For example, the processor can be configured to increase the stage by one if the measured temperature is below the predetermined desired temperature, and the processor can be configured to decrease the stage by one if the measured temperature is above the predetermined desired temperature.

For another example, the apparatus can also include a heat control configured to allow a user to set the predetermined desired temperature.

For yet another example, the processor can be configured to change the stage only once per 360° cycle of the AC power.

For still another example, each of the stages can correspond to a power level of the device ranging from 0% power to 100% power.

For another example, the apparatus can also include a circuit configured to filter the AC power input to the device prior to the processor receiving the input AC power. In some embodiments, the circuit can include an inductor and two capacitors. In some embodiments, the first heating element, the second heating element, and the circuit can each be disposed in a handle of the hair dryer. The apparatus can also include a housing of the hair dryer and can include a power cable extending from the housing configured to operatively couple to an AC source, and the handle can extend from the housing.

For yet another example, the apparatus can also include a first triac operatively coupled to the first heating element and the processor, and the processor can be configured to control the first heating element via the first triac.

For still another example, the apparatus can also include a second heating element configured to heat the air to be output from the hair dryer, and the processor can be configured to identify which one of the plurality of stages the hair dryer is operating in, each of the plurality of stages corresponding to the first predetermined phase angle of the AC power at which the processor is configured to turn on one of the first and second heating elements and to a second predetermined phase angle of the AC power at which the processor is configured to turn on the other of the first and second heating elements. In some embodiments, alternate ones of the stages can apply the first predetermined phase angle to the first heating element and the second predetermined phase angle to the second heating element with intervening ones of the stages applying the second predetermined phase angle to the first heating element and the first predetermined phase angle to the second heating element. In some embodiments, the apparatus can also include a first triac operatively coupled to the first heating element and the processor, the apparatus can also include a second heater triac operatively coupled to the second heating element and the processor, and the processor can be configured to control the first heating element via the first triac and to control the second heating element via the second triac.

For another example, the apparatus can also include a non-transitory computer-readable storage medium storing an algorithm configured to be executed by the processor to identify which one of the plurality of stages the hair dryer is operating in and to change the stage the hair dryer is operating in.

In another aspect, a method is provided that in one embodiment includes based on a phase angle of AC power powering a device and based on which one of a plurality of stages the device is operating in, causing, with a processor, a first heating element of the device heating air to be output from the device to be turned on and off.

The method can vary in any number of ways. For example, each of the plurality of stages can correspond to a first predetermined phase angle of the AC power at which the first heating element is turned on to heat the air to be output from the device. In some embodiments, the method can also include measuring, with a temperature sensor of the device, a temperature of the air to be output from the device, the processor can cause the stage to increase by one if the measured temperature is below a predetermined desired temperature, and the processor can cause the stage to decrease by one if the measured temperature is above the predetermined desired temperature. The predetermined desired temperature can be set by a user using a heat control of the device.

For another example, the method can also include, based on the phase angle of the AC power powering the device and based on which one of the plurality of stages the device is operating in, causing, with the processor, a second heating element of the device heating the air to be output from the device to be turned on and off. In some embodiments, each of the plurality of stages can correspond to a first phase angle of the AC power at which one of the first and second heating elements is turned on to heat the air to be output from the device and can correspond to a second phase angle of the AC power at which the other of the first and second heating elements is turned on to heat the air to be output from the device. In some embodiments, alternate ones of the stages can apply the first phase angle to the first heating element and the second phase angle to the second heating element with intervening ones of the stages applying the second phase angle to the first heating element and the first phase angle to the second heating element. In some embodiments, a dead zone can be in each 360° cycle of the AC power such that none of the first and second phase angles are in the dead zone. In some embodiments, the processor can control the first heating element via a first heater triode for alternating current (triac) of the device and can control the second heating element via a second triac of the device. In some embodiments, the method can also include measuring, with a temperature sensor of the device, a temperature of the air to be output from the device, the processor can cause the stage to increase by one if the measured temperature is below a predetermined desired temperature, and the processor can cause the stage to decrease by one if the measured temperature is above the predetermined desired temperature. The predetermined desired temperature can be set by a user using a heat control of the device.

For still another example, the processor can only change the stage of the device once per 360° cycle of the AC power.

For yet another example, each of the stages can correspond to a power level of the device ranging from 0% power to 100% power.

For still another example, the method can also include filtering, with a circuit, the AC power input to the device prior to the processor receiving the input AC power. In some embodiments, the circuit can include an inductor and two capacitors.

For another example, the device can be a hair dryer, and the first heating element and the second heating element can be disposed in a handle of the hair dryer.

For still another example, the processor can control the first heating element via a first heater triode for alternating current (triac) of the device.

For yet another example, a non-transitory computer-readable storage medium can include a program for execution by the processor, and the program can include instructions which, when executed by the processor, cause the device to perform the method.

BRIEF DESCRIPTION OF DRAWINGS

This disclosure will be more fully understood from the following detailed description taken in conjunction with the accompanying drawings, in which.

DETAILED DESCRIPTION

Figure 2:
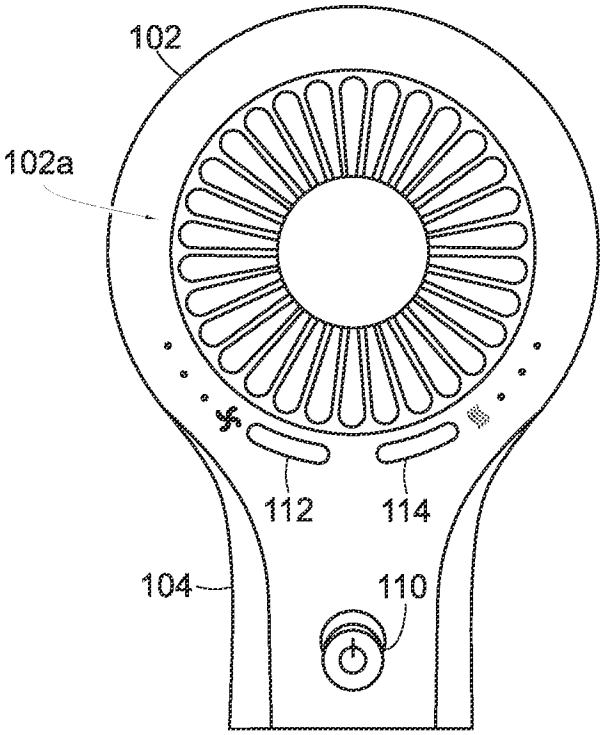
FIG. 2 is a rear view of a portion of the hair dryer of FIG. 1.

Certain embodiments will now be described to provide an overall understanding of the principles of the structure, function, manufacture, and use of the devices, systems, and methods disclosed herein. One or more examples of these embodiments are illustrated in the accompanying drawings. Those skilled in the art will understand that the devices, systems, and methods specifically described herein and illustrated in the accompanying drawings are non-limiting embodiments and that the scope of the present invention is defined solely by the claims. The features illustrated or described in connection with one exemplary embodiment may be combined with the features of other embodiments. Such modifications and variations are intended to be included within the scope of the present invention.

Further, in the present disclosure, like-named components of the embodiments generally have similar features, and thus within a particular embodiment each feature of each like-named component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape.

Various exemplary devices, systems, and methods for phase control heater control are provided. In general, a hair dryer includes a heater configured to heat air for output from the hair dryer. The hair dryer is configured to heat the air with the heater using phase control. The phase control is configured to control the heater to heat the air to a desired temperature (e.g., to a particular desired temperature or within a desired temperature range) while reducing periodic current draw on the hair dryer's AC input. Reducing the periodic current draw, which can be eliminating periodic current draw entirely, reduces or prevents the hair dryer from causing light flickering, causing inconvenient circuit breaker trips, and/or appliance (e.g., microwave, fan, etc.) power fluctuation. The phase control is configured to control the heater according to predetermined phase angles in an AC power cycle. The heater is configured to be turned on and off only at the predetermined phase angles in the AC power cycle, with a "dead zone" of phase angles being within the AC power cycle at which the heater cannot be turned on or off, e.g., a heater triode for alternating current (triac) for the heater cannot be fired. Using the "dead zone" in the phase control may avoid high dV/dt, and hence avoid high dI/dT, and the adverse periodic current draw effects related thereto.

The phase control can be implemented using a heat control circuit contained within the hair dryer, such as within a handle of the hair dryer. EMC filtering components, such as an EMC box, therefore is not needed, thereby improving aesthetics of the hair dryer, making the cord lighter, and making the cord easier to store and/or coil.

The phase control allows the hair dryer to satisfy regulatory requirements, e.g., FCC part 15 regarding conducted emissions for devices qualifying under 47 CFR 15.5 without the need for additional EMC filtering components such as an EMC box on the hair dryer's cord.

The methods, systems, and devices described herein for phase control heater control can be used with devices other than hair dryers that use heaters for heat control, such as space heaters.

Figure 1:
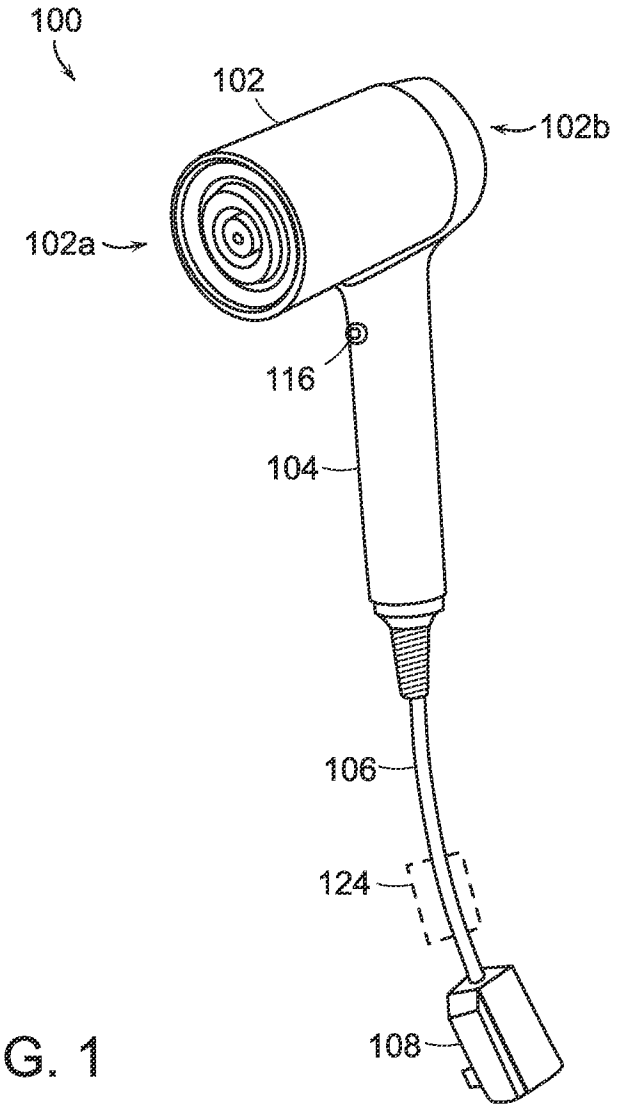
FIG. 1 is a perspective view of one embodiment of a hair dryer.

FIG. 1 illustrates one embodiment of a hair dryer 100 configured to include phase control heater control. The hair dryer 100 includes a housing 102, a handle 104 extending from the housing 102 in a generally downward direction transverse to the housing 102, a cord (also referred to herein as a "power cable") 106 extending from the handle 104, and a plug 108 at an end of the cord 106 and configured to plug into a power outlet. A person skilled in the art will appreciate that the hair dryer 100 can have a variety of configurations and that the methods, systems, and devices described herein for phase control heater control can be used with any hair dryer that uses heaters for heat control of output air.

The housing 102 is in the form of a generally hollow body that is configured to contain components for operation of the hair dryer 100, such as a motor, a heater, a processor, and a memory. The illustrated housing 102 has a circular cross-section, but other cross-sectional shapes can be utilized. In order to allow the motor and heater to supply air, the housing 102 includes an input end 102*a* and an output end 102*b* arranged on opposite ends of the housing 102. The input end 102*a* is configured to allow for air intake into the housing 102, and the output end 102*b* is configured to supply air after passing through the motor and/or heater. The output end 102*b* of the hair dryer 100 can be configured to removably mate with an accessory (not shown), e.g., a concentrator, a diffuser, a brush, a curler, etc.

Since the process of hair drying can require directional control of the hair dryer, the handle 104 is included to allow for hand-held use of the hair dryer 100. The handle 104 can extend from the housing 102 in a fixed orientation, or the handle 104 can be movably (e.g., pivotally) attached to the housing 102. The handle 104 includes a power button 110, shown in FIG. 2, configured to be actuated by a user to selectively turn the hair dryer 100 on and off. The hair dryer's power control is in the form of a depressible button 110 in this illustrated embodiment but can have another form, such as a lever, a rotatable knob, etc.

The hair dryer 100 can include other control mechanisms for controlling various aspects of the hair dryer 100. As shown in FIGS. 1 and 2, the hair dryer 100 in this illustrated embodiment includes an airflow control button 112, a temperature control button 114, a cool shot button 116, and a reset button (on the plug 108 in this illustrated embodiment but obscured in FIG. 1). The airflow control button 112 is configured to be actuated by a user to select an airflow speed. For example, actuation of the airflow control button 112 can toggle the hair dryer 100 between different airflow speeds, e.g., low, medium, and high. The temperature control button 114 is configured to be actuated by a user to select a heat level for air flowing out the output end 102*b* of the hair dryer 100. For example, actuation of the temperature control button 114 can toggle the hair dryer 100 between different heat settings, e.g., low, medium, and high. The cool shot button 116 is configured to be actuated by a user to cause a shot of cool, unheated air to flow out the output end 102*b* of the hair dryer 100, e.g., to set hairstyle. The reset button, e.g., an Appliance Leakage Circuit Interrupter (ALCI), is configured to be actuated by a user to reset the hair dryer 100 in the event of an error. The airflow, temperature, cool shot, and reset controls are each in the form of a depressible button in this illustrated embodiment but any one or more of these controls can have another form, such as a lever, a rotatable knob, etc.

The power cable 106 extends from the handle 104 and is electrically connected to the electrical components within the hair dryer 100, such as the motor, heater, processor, and memory. The plug 108 is at an end of the power cable 106 opposite to the handle 104 and is configured to be plugged into an electrical outlet for providing AC power to the hair dryer 100.

Figure 3:
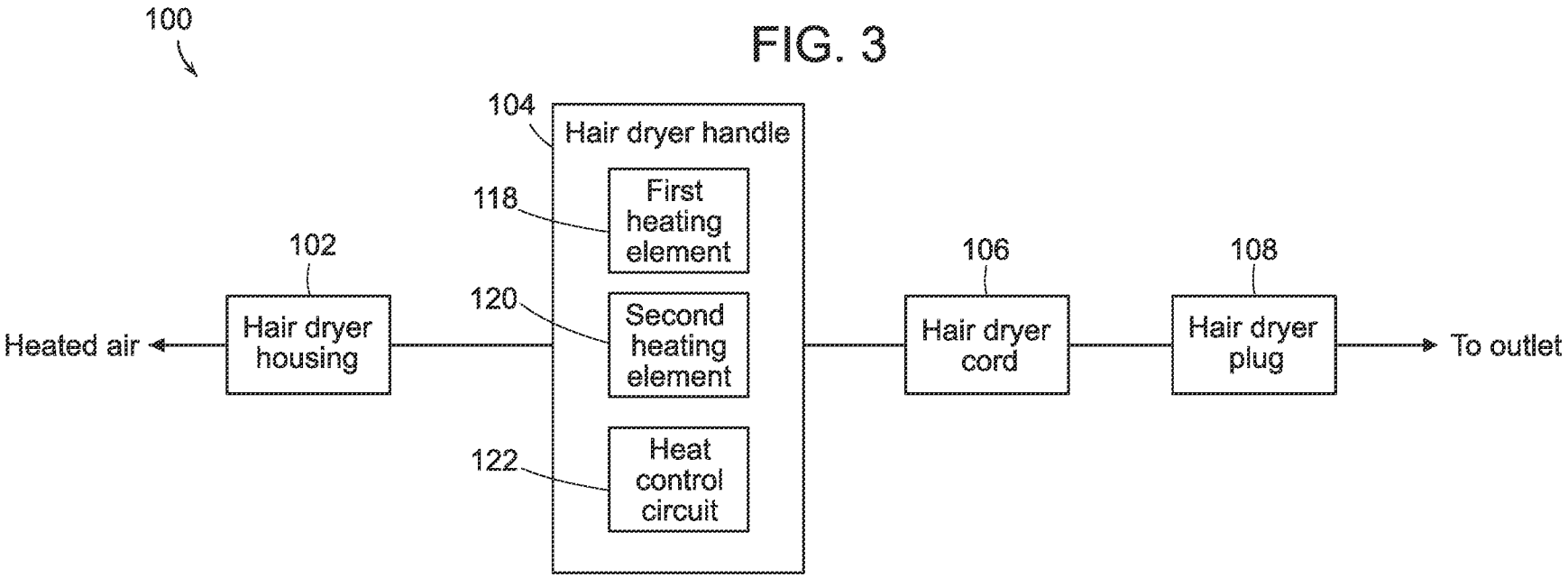
FIG. 3 is a schematic view of the hair dryer of FIG. 1.

As mentioned above, the hair dryer 100 includes various components for operation of the hair dryer 100. As shown in FIG. 3, the hair dryer 100 in this illustrated embodiment includes a first heating element (also referred to herein as a "heater") 118, a second heating element 120, and a heat control circuit 122. The first heating element 118, the second heating element 120, and the heat control circuit 122 are disposed within the handle 104. The heat control circuit 122 facilitates the hair dryer's satisfaction of regulatory requirements, e.g., FCC part 15, without the hair dryer 100 needing to include a filter on the hair dryer's cord 106, such as an EMC box 124 that is shown in phantom in FIG. 1 indicative of an EMC box for traditional hair dryers. In this illustrated embodiment, the hair dryer 100 includes two heaters 118, 120 configured to be controlled using the phase control described herein. In other embodiments, the hair dryer 100 can include one heater, e.g., only the first heater 118, configured to be controlled using the phase control described herein.

The first and second heating elements 118, 120 are configured to heat unheated air for output as heated air from the output end 102*a* of the hair dryer 100. The first and second heating elements 118, 120 are each of a same type and can have any of a variety of configurations, as will be appreciated by a person skilled in the art.

The heat control circuit 122 is configured to control the first and second heating elements 118, 120 and thus control heating of the air that is output from the hair dryer 100 at the output end 102*a*. As discussed further below, the heat control circuit 122 is configured to control the first and second heating elements 118, 120 using phase control. In general, the heat control circuit 122 is configured to control the first and second heating elements 118, 120 to achieve the temperature setting selected by a user using the temperature control button 114. In some implementations, the temperature setting is a particular desired temperature. In other implementations, the temperature setting is a desired temperature range, e.g., a first temperature range corresponding to a low temperature setting, a second temperature range corresponding to a medium temperature setting and being higher than the first temperature range, and a third temperature range corresponding to a high temperature setting and being higher than the second temperature range.

The heat control circuit 122 can include a memory storing machine-executable instructions and can include a processor configured to execute the instructions to control the first and second heating elements 118, 120. In some implementations, the memory and the processor of the heat control circuit 122 are dedicated to the heat control circuit 122, and the hair dryer 100 includes another memory and another processor configured to control other aspects of the hair dryer 100, e.g., airflow speed, power, etc. In other implementations, the memory and the processor of the heat control circuit 122 are a memory and processor for the hair dryer 100, e.g., are not dedicated to the heat control circuit 122, and are thus also usable for other aspects of the hair dryer 100, e.g., airflow speed, power, etc.

Figure 4:
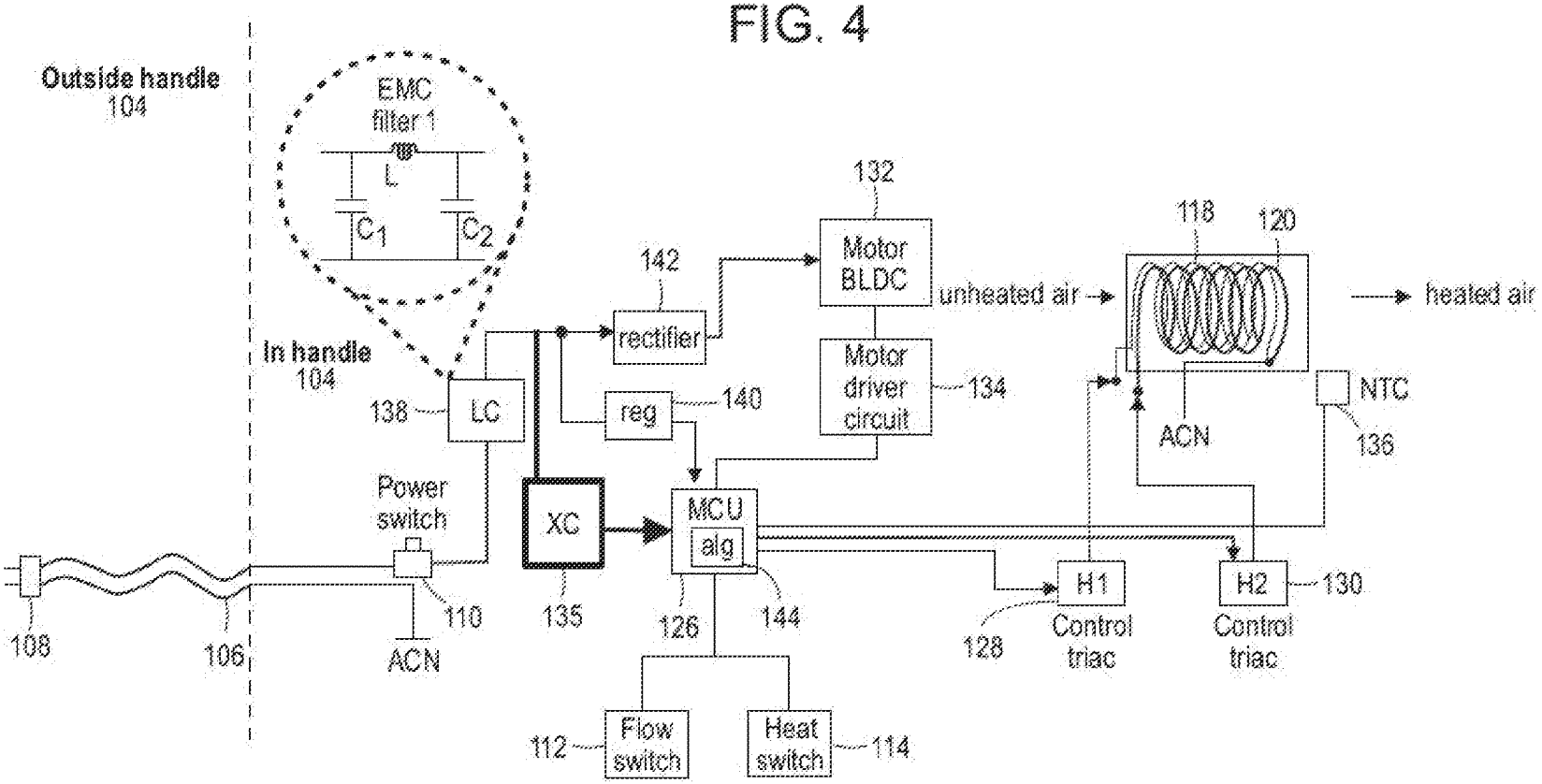
FIG. 4 is a schematic view of a portion of the hair dryer of FIG. 1.

In this illustrated embodiment, as shown in FIG. 4, the hair dryer 100 includes a microcontroller (MCU) 126 that includes a processor and a memory. In other embodiments, the processor and the memory can be separate components. The processor and memory, e.g., the MCU 126, are included in but not dedicated to the heat control circuit 122 in this illustrated embodiment. The processor, e.g., the MCU 126, is communicably coupled with the power button 110 (labeled "power switch" in FIG. 4), the airflow control button 112 (labeled "flow switch" in FIG. 4), the temperature control button 114 (labeled "heat switch" in FIG. 4), a first heater triode for alternating current (triac) 128 of the heat control circuit 122, a second heater triac 130 of the heat control circuit 122, a motor 132 via a motor driver circuit 134 (labeled "mtr driver circuit" in FIG. 4), a "zero-cross"

detection circuit 135 (labeled "XC" in FIG. 4) of the heat control circuit 122, and a temperature sensor 136 (labeled "NTC" in FIG. 4 to indicate an NTC thermistor) of the heat control circuit 122. The first heater triac 128 is operatively coupled with the first heating element 118, and the second heater 130 triac is operatively coupled with the second heating element 120. In embodiments with only one heater, only one triac would be present. The motor 132 is a brushless electric direct current (BLDC) motor in this illustrated embodiment but can have other configurations, as will be appreciated by a person skilled in the art. The temperature sensor 136 is a negative temperature coefficient (NTC) sensor in this illustrated but can have other configurations, as will be appreciated by a person skilled in the art.

A filter 138 (labeled "LC" and "EMC filter 1" in FIG. 4) of the heat control circuit 122 is disposed between the power button 110 and the processor, e.g., the MCU 126. The filter 138 is an LC circuit including first and second capacitors C1, C2 in parallel and an inductor L in series with the first and second capacitors C1, C2. The filter 138 is configured to receive AC power with the power turned on, e.g., when the plug 108 is plugged into an outlet and the power button 110 has been actuated by a user to turn on the hair dryer 100, and thus to filter the AC before power reaches the MCU 126 and before power reaches the motor 132. The filter 138 is also configured to prevent AC noise from the hair dryer 100 unit, e.g., self-generated noise, from going back to the power grid (regulated by FCC as conducted emissions). Such filtering is generally known as AC noise immunity and filters noise coming from the power grid to the apparatus plugged into the power grid and prevents noise self-generated at the apparatus from going back to the power grid (regulated by FCC as conducted emissions). As the size of such a filter becomes larger, less emissions result. If the filter becomes too big, the filter cannot fit inside the hair dryer, e.g., inside the hair dryer's handle and/or the hair dryer's housing, and thus must be located on the hair dryer's cord. As shown in FIG. 4, the filter 138 of the hair dryer 100 is small enough to be located within the hair dryer 100, e.g., within the handle 104, due to the heat control circuit 122, discussed further below, providing less emissions and less self-generated noise. A filter such as an EMC box is thus not located on the cord 106.

In this illustrated embodiment, a regulator 140 (labeled "erg" in FIG. 4) is disposed between the filter 138 and the MCU 126, and a rectifier 142 is disposed between the filter 138 and the motor 132.

The memory of the hair dryer 100 (e.g., the memory of the MCU 126) stores therein an algorithm 144 (labeled "alg" in FIG. 4) configured to be executed by the processor of the hair dryer 100 (e.g., the processor of the MCU 126) to provide phase control. In general, the phase control is configured to control the heat provided by the first and second heating elements 118, 120 by controlling the first and second triacs 128, 130. The phase control considers phase angles in the heater control, and in particular considers predetermined phase angles for heater activation (on) and deactivation (off) with a "dead zone" where the heater cannot be activated or deactivated.

Figure 5:
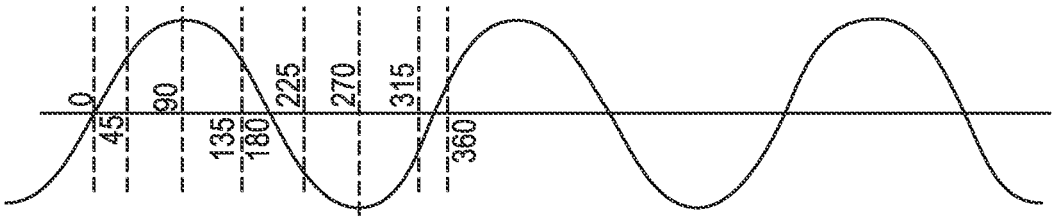
FIG. 5 is a graph showing an AC power sinusoidal curve.

FIG. 5 illustrates an AC power sinusoidal curve with phase angles labeled from 0° to 360° along the x axis, which represents time (t). The vertical axis represents voltage (V). The sinusoidal curve is either at a 60 Hz frequency or a 50 Hz frequency, depending on standards in different regions of the world. As shown, as the AC power signal oscillates, it crosses the zero line (x axis) every 180°. Turning the first heater 118 and/or the second heater 120 on/off at various times along the sinusoidal curve to control the heat output of the hair dryer 100 can cause undesirable periodic current draw depending on the phase angle at which the heater is activated, e.g., at which the heater's triac is turned on. FIGS. 6-10 demonstrate how when a heater is turned on or off along the AC power sinusoidal curve, current draw is affected.

Figure 6:
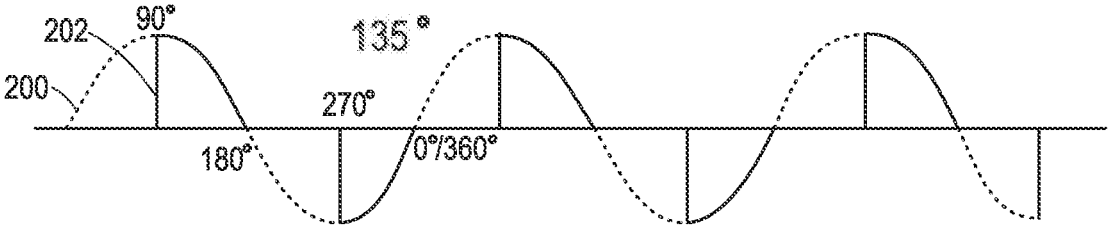
FIG. 6 is a graph showing the AC power sinusoidal curve of FIG. 5 and one embodiment of a power line for a heater.

FIG. 6 illustrates an AC power sinusoidal curve 200 and a power line 202 for a heater, e.g., the first heater 118 or the second heater 120. The heater is turned on with the phase angle at 90° and is turned off with the phase angle at 180° and is turned back on with the phase angle at 270° and subsequently turned off with the phase angle at 360°/0°. The heater on timing at 90° and 270° provides a worst case dI/dt and dV/dt scenario having large current spikes and thus large electromagnetic interference (EMI). FIG. 6 thus also illustrates a worst case periodic current draw scenario, since the voltage change between the zero voltage line (x axis) and the voltage when the heater is turned on is at its highest, e.g., at the highest points of the AC curve at phase angles 90° and 270°, and thus causes EMC noise, specifically conducted and radiated emissions.

Figure 7:
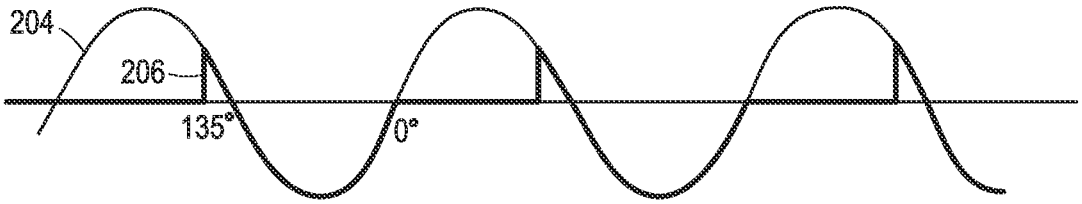
FIG. 7 is a graph showing the AC power sinusoidal curve of FIG. 5 and another embodiment of a power line for a heater.

FIG. 7 illustrates an AC power sinusoidal curve 204 and a power line 206 for a heater, e.g., the first heater 118 or the second heater 120. The heater is turned on with the phase angle at 135° and is turned off with the phase angle at 0°. (The heater also turned back on at 180°, as every time the AC signal passes through zero, it will turn off unless specifically controlled to be on.) The heater on/off timing of FIG. 7 provides a better case dI/dt and dV/dt scenario, and thus a better case periodic current draw scenario, than in FIG. 6 because the voltage change between the zero voltage line (x axis) and the voltage when the heater is turned on or off is not as high, e.g., the voltage increases or decreases less because there is less vertical distance to/from the zero voltage line (x axis) and in the case of the heater being turned off no distance. However, high heat may be difficult to achieve.

Figure 8:
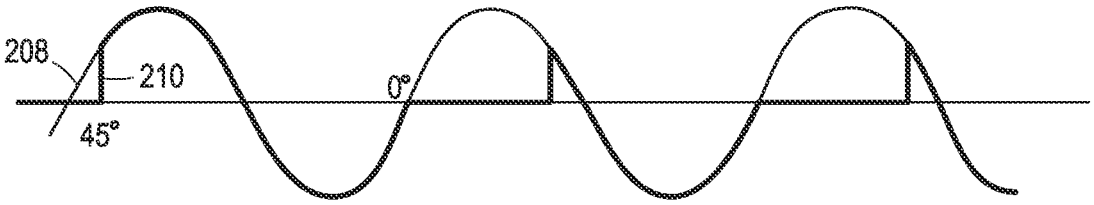
FIG. 8 is a graph showing the AC power sinusoidal curve of FIG. 5 and yet another embodiment of a power line for a heater.

FIG. 8 illustrates an AC power sinusoidal curve 208 and a power line 210 for a heater, e.g., the second heater 120. The heater is turned on with the phase angle at 45° and is turned off with the phase angle at 0°. The heater on/off timing of FIG. 8 provides a similar case dI/dt and dV/dt scenario as FIG. 7, e.g., the voltage increases (heater turned on) or decreases (heater turned off) less because there is less vertical distance to/from the zero voltage line (x axis) than in FIG. 6 and in the case of the heater being turned off no distance. However, high heat may be difficult to achieve.

Figure 9:
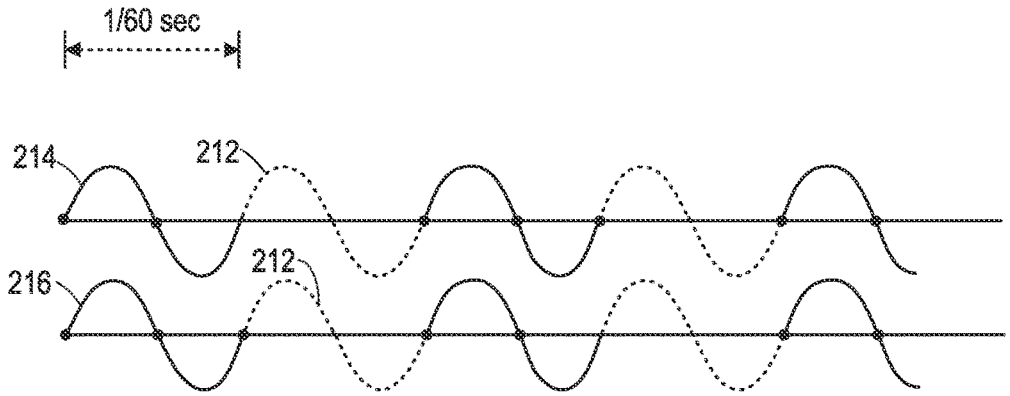
FIG. 9 is a pair of graphs each showing the AC power sinusoidal curve of FIG. 5 and embodiments of power lines for first and second heaters.

FIG. 9 illustrates an AC power sinusoidal curve 212 and first and second power lines 214, 216 for first and second heaters, e.g., the first and second heaters 118, 120. The AC power sinusoidal curve 212 is at 60 Hz in this example. The first and second heaters are each turned on at 0° and turned off at 0°, 360° later, and then remain off for 360° before being turned on again at 0° with the pattern repeating. In other words, the first and second heaters have a "distributed" waveform pattern in which the first and second heaters are each on for 1/60 sec and then off for 1/60 sec, with this on/off pattern repeating. The "distributed" waveform pattern achieves 50% power and has low dI/dt and dV/dt but still causes flickering and/or a circuit breaker trip due to periodic current draw because of the first and second heaters each being off for a complete 360° cycle of the AC power sinusoidal curve 212 so as to appear as if the frequency was 30 Hz instead of 60 Hz. The human eye more easily sees lower light frequencies, so 30 Hz is more noticeable to the human eye than 60 Hz, which the human eye cannot perceive easily.

Figure 10:
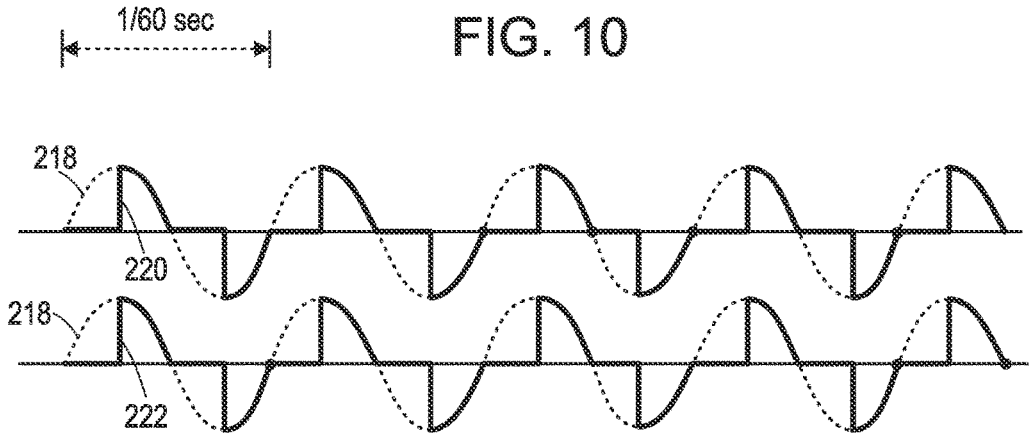
FIG. 10 is a pair of graphs each showing the AC power sinusoidal curve of FIG. 5 and other embodiments of power lines for first and second heaters.

FIG. 10 illustrates an AC power sinusoidal curve 218 and first and second power lines 220, 222 for first and second heaters, e.g., the first and second heaters 118, 120. The AC power sinusoidal curve 218 is at 60 Hz in this example. The first and second heaters are each turned on at 90°, turned off at 180°, turned on at 270°, and turned off at 360°/0°, with the pattern repeating. In other words, the first and second heaters have a "chopping" waveform pattern in which the first and second heaters are each turned on/off every 180° and 50% power is achieved. The heater on/off timing of FIG. 10 does not cause the flickering of the FIG. 9 heater on/off timing, but does provide a worst case dV/dt and dI/dt scenario for each heater similar to that of FIG. 6.

Figure 11:
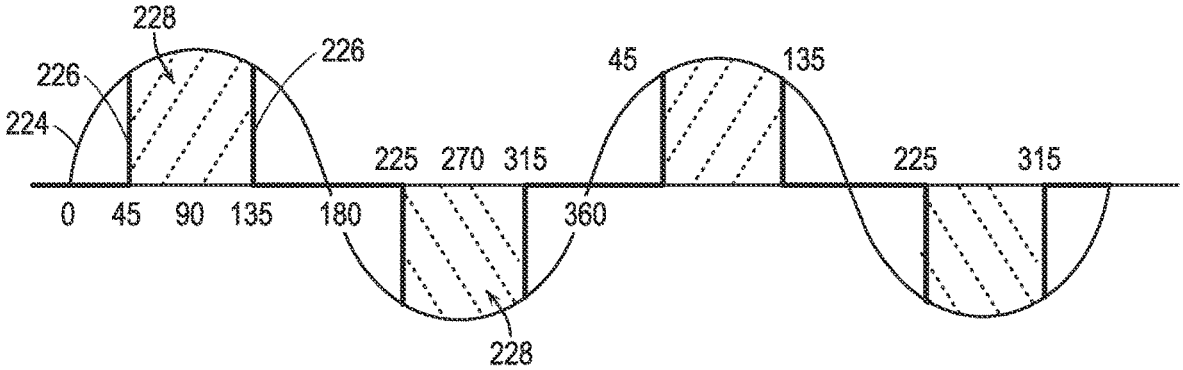
FIG. 11 is a graph showing one embodiment of "dead zone" phase control.

FIG. 11 illustrates an AC power sinusoidal curve 224 and a power line 226 for each of the first and second heaters 118, 120 according to the phase control of the hair dryer 100, e.g., as provided using the heat control circuit 122 and the algorithm 144 of FIG. 4. FIG. 11 illustrates the "dead zone" provided by the phase control and phase angles at which the first and second triacs 128, 130 are not fired, e.g., not fired due to high dV/dt and hence high dI/dT. The first and second heaters 118, 120 are limited to being turned on or off at six phase angles: 0°, 45°, 135°, 180°, 225°, and 315°. A dead zone 228 is thus provided between 45° and 135° and between 225° and 315°. Turning the first and second heaters 118, 120 on or off at 0°, 45°, 135°, 180°, 225°, or 315° provides a better case dV/dt and dI/dt scenario by providing for a lower dI/dt across all AC cycles, and thus provides a better case periodic current draw scenario, than in FIGS. 6 and 10 because the voltage change between the zero voltage line (x axis) and the voltage when the heater is turned on or off is not as high, e.g., the voltage increases or decreases less because there is less vertical distance to/from the zero voltage line (x axis) and in the case of the heater being turned off no distance. The heaters 118, 120 are not off for a complete cycle, unlike the scenario of FIG. 9, so flickering can be avoided.

The phase control of the algorithm 144 is configured to use stages to control the heaters 118, 120 consistent with the scenario of FIG. 11. Each stage corresponds to a particular phase angle setting for each of the first and second heaters 118, 120 in one 360° cycle of the AC power sinusoidal curve 224, e.g., in one 60 Hz or 50 Hz cycle. In this way, the number of dV/dt (and dI/dt) events per cycle can be minimized, thereby minimizing periodic current draw and hence conducted and radiated emissions from the hair dryer 100.

Table 1 shows phase angle settings for the first and second heaters 118, 120 in each of thirteen stages numbered zero to twelve. The first and second heaters 118, 120 are variously set at phase angle settings A and B as discussed further below. Angle setting A is either always OFF (heater off) or a phase change at 0° or 180°. As discussed above, a heater being turned on or off at 0° and 180° allows for no voltage change. Table 1 also shows for each stage a number of dV/dt (and thus dI/dt) events per 360° cycle of the AC power sinusoidal curve 224. Table 1 also shows a power setting, shown as percentage (%) power, for each stage. Thirteen stages are used in this embodiment, but another number of stages can be used. In general, the lower the number of stages, the less the precision for heat control the hair dryer 100 will have.

TABLE 1

| Stage | % power | Angle Setting A | Angle Setting B | # of dV/dt in 360° |
|---|---|---|---|---|
| 0 | 0 | OFF | OFF | 0 |
| 1 | | OFF | 315 | 1 |
| 2 | | OFF | 225 | 1 |
| 3 | 25 | 180 | OFF | 0 |
| 4 | | 180 | 315 | 1 |
| 5 | | 180 | 225 | 1 |
| 6 | 50 | 0 & 180 | OFF | 0 |
| 7 | | 0 & 180 | 315 | 1 |
| 8 | | 0 & 180 | 225 | 1 |
| 9 | 75 | 0 & 180 | 180 | 0 |
| 10 | | 0 & 180 | 135 & 180 | 1 |
| 11 | | 0 & 180 | 45 & 180 | 1 |
| 12 | 100 | 0 & 180 | 0 & 180 | 0 |

Figure 12:
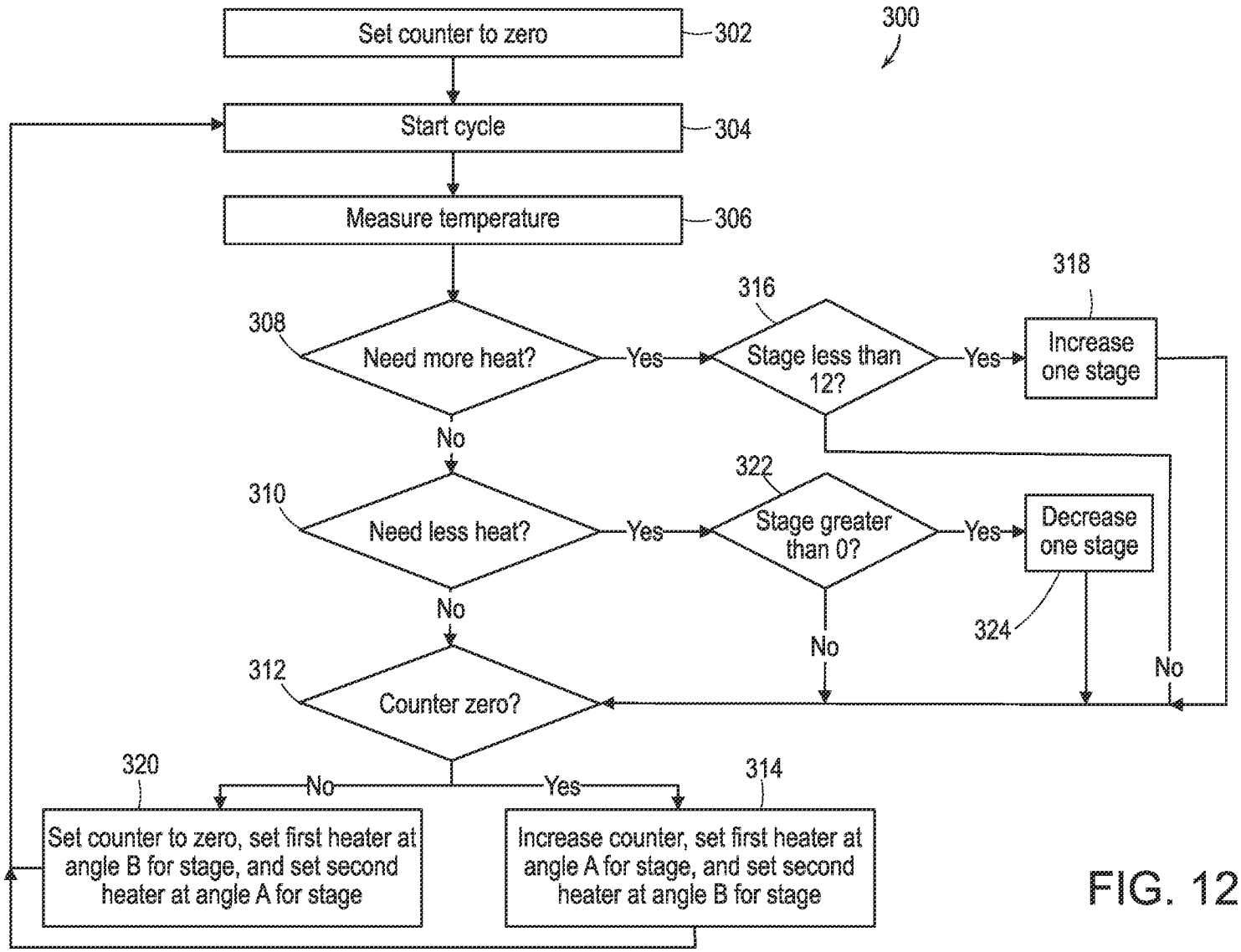
FIG. 12 is a flowchart showing one embodiment of a method for phase control heat control.

FIG. 12 illustrates one embodiment of a method 300 for phase control heat control. The method 300 is described with respect to the hair dryer 100 of FIGS. 1-4 such that the algorithm 144 is executed by the processor, e.g., the processor of the MCU 126, to perform the method 300 but can be similarly implemented using other hair dryers or using other devices that use heaters for heat control, such as space heaters. Additionally, the method 300 is described with respect to the two heaters 118, 120 of the hair dryer 100 but can be similarly implemented using one heater of a hair dryer.

In the method 300, a value of a counter is set 302 to zero. The counter value is stored in the memory of the hair dryer 100, e.g., the memory of the MCU 126. The initial value of the counter is zero in this illustrated embodiment but can be another value initially. The stage begins at zero and can also be stored in the memory of the hair dryer 100.

A cycle of the AC power sinusoidal curve 224 starts 304 when the hair dryer 100 is powered on, e.g., when the power button 110 is actuated by a user to turn on the hair dryer 100. The zero-cross detection circuit 135 is configured to determine the cycle. In general, the zero-cross detection circuit 135 is configured to detect when the AC power sinusoidal curve 224 crosses the zero line (x axis) and thus to detect a zero voltage reference point of the AC power sinusoidal curve 224. The zero-cross detection circuit 135 is configured to provide an output to the processor (e.g., the processor of the MCU 126) indicating the detected zero-line crosses, which the processor then uses to determine the cycle since time is known between the zero-line crosses. A temperature of the heated air being output from the outer end 102*b* of the hair dryer 100 is measured 306, e.g., using the temperature sensor 136 (which as mentioned above is an NTC thermistor in this illustrated embodiment). The temperature can be measured simultaneously with the start 304 of the cycle or a nominal amount of time after the start 304 of the cycle, e.g., to account for a nominal delay of the processor of the hair dryer 100, e.g., the processor of the MCU 126, receiving power.

The processor determines 308 based on the measured 306 temperature whether more heat is needed to achieve the desired temperature. The desired temperature corresponds to the particular temperature or to the temperature range set via the temperature control button 114. If the measured 306 temperature is at or above the desired temperature, e.g., is greater than or equal to the particular desired temperature or is within or above the desired temperature range, then more heat is not needed. The processor then determines 310 based on the measured 306 temperature whether less heat is needed to achieve the desired temperature. If the measured 306 temperature is at or below the desired temperature, e.g., is less than or equal to the particular desired temperature or is within or below the desired temperature range, then less heat is not needed. The processor determines 308 whether more heat is needed before determining 310 whether less heat is needed in this this illustrated embodiment, but the processor 308 could instead first determine 310 whether less heat is needed before determining 308 whether more heat is needed.

Having determined 308 that more heat is not needed and having determined 310 that less heat is not needed, the processor determines 312 whether the counter value is zero, e.g., by checking the stored counter value in the memory. If the counter value is zero, the processor increases 314 the counter (e.g., by one or some other predetermined amount), sets 314 the first heater 118 via the first triac 128 at the angle setting A (see Table 1) for the current stage, and sets 314 the second heater 120 via the second triac 130 at the angle setting B (see Table 1) for the current stage. Since the stage is initially zero, and evaluating the first measured 306 temperature after the hair dryer 100 has been powered has indicated that neither more heat nor less heat is needed, the first heater 118 is already set at the angle setting A of OFF and the second heater 120 is already set at the angle setting B of OFF. The first and second heaters 118, 120 are thus not turned on or off in the 360° cycle, as indicated by the zero number of dV/dt for stage zero in Table 1. A next cycle then starts 304.

Returning to the processor's determination 308 as to whether more heat is needed to achieve the desired temperature, if the measured 306 temperature is below the desired temperature, e.g., is below the particular desired temperature or is below the desired temperature range, then more heat is needed. The processor determines 316 whether the stage is less than twelve, e.g., determines 316 whether the stage is at the highest stage (which is numbered 12 in the illustrated embodiment of Table 1). If the stage is less than twelve, e.g., is not at the highest stage, then the processor increases 318 the stage by one, e.g., increase the stage from zero to one, from one to two, from two to three, etc. Increasing the stage by one, and only by one in a single cycle, may help prevent periodic current draw because angle settings are being incrementally increased/decreased per cycle. As indicated in Table 1, increasing 318 the stage corresponds to increasing the power and changing the angle settings A and B. As the stage can be stored in the memory, increasing the stage can involve the processor updating the stage value or other stage indicator stored in the memory. The processor then determines 312 whether the counter value is zero, as discussed above. If the counter value is zero, the processor increases 314 the counter (e.g., by one or some other predetermined amount), sets 314 the first heater 118 via the first triac 128 at the angle setting A (see Table 1) for the current stage, and sets 314 the second heater 120 via the second triac 130 at the angle setting B (see Table 1) for the current stage. At least one of the first and second triacs 128, 130 will have its angle setting changed because the stage was increased 318 by one. If the counter value is not zero, the processor sets 320 the counter to zero, sets 320 the first heater 118 via the first triac 128 at the angle setting B (see Table 1) for the current stage, and sets 320 the second heater 120 via the second triac 130 at the angle setting A (see Table 1) for the current stage. At least one of the first and second triacs 128, 130 will have its angle setting changed because the stage was increased 318 by one.

The processor determining 312 whether the counter value is zero determines which of the first and second heaters 118, 120 is set at the angle setting A and which of the first and second heaters 118, 120 is set at the angle setting B. Changing the counter, e.g., by increasing 314 the counter or setting 316 the counter to zero, once per cycle helps ensure that power into the first and second heater 118, 120 is evenly distributed every cycle.

If the processor determines 316 that the stage is not less than twelve, e.g., is at the highest stage, then more heat cannot be provided because power is already at 100%, as indicated in Table 1. The processor then determines 312 whether the counter value is zero and continues the method 300 as discussed above.

Returning to the processor's determination 310 as to whether less heat is needed to achieve the desired temperature, if the measured 306 temperature is above the desired temperature, e.g., is above the particular desired temperature or is above the desired temperature range, then less heat is needed. The processor determines 322 whether the stage is greater than zero, e.g., determines 322 whether the stage is at the lowest stage (which is numbered 0 in the illustrated embodiment of Table 1). If the stage is greater than zero, e.g., is not at the lowest stage, then the processor decreases 324 the stage by one, e.g., decrease the stage from twelve to eleven, from eleven to ten, from ten to nine, etc. Decreasing the stage by one, and only by one in a single cycle, may help prevent periodic current draw because angle settings are being incrementally increased/decreased per cycle. As indicated in Table 1, decreasing 324 the stage corresponds to decreasing the power and changing the angle settings A and B. As the stage can be stored in the memory, decreasing the stage can involve the processor updating the stage value or other stage indicator stored in the memory. The processor then determines 312 whether the counter value is zero and the method 300 continues, as discussed above.

If the processor determines 322 that the stage is not greater than zero, e.g., is at the lowest stage, then less heat cannot be provided because power is already at 0%, as indicated in Table 1. The processor then determines 312 whether the counter value is zero and continues the method 300 as discussed above.

The method 300 continues per cycle until power is turned off, e.g., the hair dryer's power button 110 is actuated to turn off the hair dryer 100.

Actuation of the cool shot button 116 at any time during performance of the method 300 can temporarily stop the first and second heaters 118, 120 from providing any heat while the cool shot button 116 is depressed to allow for the shot of cool, unheated air to flow out the output end 102*b* of the hair dryer 100.

The subject matter described herein can be implemented in analog electronic circuitry, digital electronic circuitry, and/or in computer software, firmware, or hardware, including the structural means disclosed in this specification and structural equivalents thereof, or in combinations of them. The subject matter described herein can be implemented as one or more computer program products, such as one or more computer programs tangibly embodied in an information carrier (e.g., in a machine-readable storage device), or embodied in a propagated signal, for execution by, or to control the operation of, data processing apparatus (e.g., a programmable processor, a computer, or multiple computers). A computer program (also known as a program, algorithm, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code).

The processes and logic flows described in this specification, including the method steps of the subject matter described herein, can be performed by one or more programmable processors executing one or more computer programs to perform functions of the subject matter described herein by operating on input data and generating output. The processes and logic flows can also be performed by, and apparatus of the subject matter described herein can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processor of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, (e.g., EPROM, EEPROM, and flash memory devices). The processor and the memory can be supplemented by, or incorporated in, special purpose logic circuitry.

The techniques described herein can be implemented using one or more modules. As used herein, the term "module" refers to computing software, firmware, hardware, and/or various combinations thereof. At a minimum, however, modules are not to be interpreted as software that is not implemented on hardware, firmware, or recorded on a non-transitory processor readable recordable storage medium (i.e., modules are not software per se). Indeed "module" is to be interpreted to always include at least some physical, non-transitory hardware such as a part of a processor or computer. Two different modules can share the same physical hardware (e.g., two different modules can use the same processor). The modules described herein can be combined, integrated, separated, and/or duplicated to support various applications. Also, a function described herein as being performed at a particular module can be performed at one or more other modules and/or by one or more other devices instead of or in addition to the function performed at the particular module.

One skilled in the art will appreciate further features and advantages of the devices, systems, and methods based on the above-described embodiments. Accordingly, this disclosure is not to be limited by what has been particularly shown and described, except as indicated by the appended claims. All publications and references cited herein are expressly incorporated herein by reference in their entirety for all purposes.

The present disclosure has been described above by way of example only within the context of the overall disclosure provided herein. It will be appreciated that modifications within the spirit and scope of the claims may be made without departing from the overall scope of the present disclosure.

What is claimed is:

1. An apparatus, comprising:

a first heating element and a second heating element configured to heat air to be output from a device powered with alternating current (AC) power; and a processor configured to, based on a phase angle of the AC power and based on which one of a plurality of predetermined stages the device is operating in, control turning on and off the first heating element and control turning on and off the second heating element by incrementally transitioning between the plurality of predetermined stages, wherein each of the plurality of predetermined stages correspond to a predetermined phase angle of the AC power necessary to energize at least one of the first and second heating elements.

2. The apparatus of claim 1, wherein each of the plurality of predetermined stages corresponds to a predetermined phase angle of the AC power at which the first heating element is turned on to heat the air to be output from the device.

3. The apparatus of claim 2, wherein a dead zone is in each 360° cycle of the AC power such that none of the predetermined phase angles are in the dead zone.

4. The apparatus of claim 2, further comprising a temperature sensor configured to measure a temperature of the air to be output from the device;

wherein the processor is configured to increase the stage by one if the measured temperature is below a predetermined desired temperature; and the processor is configured to decrease the stage by one if the measured temperature is above the predetermined desired temperature.

5. The apparatus of claim 4, further comprising a heat control configured to allow a user to set the predetermined desired temperature.

6. The apparatus of claim 1, wherein the processor is configured to, based on the phase angle of the AC power and based on which one of the plurality of predetermined stages the device is operating in, control turning on and off the second heating element.

7. The apparatus of claim 5, wherein each of the plurality of predetermined stages corresponds to a first predetermined phase angle of the AC power at which one of the first and second heating elements is turned on to heat the air to be output from the device and corresponds to a second predetermined angle phase of the AC power at which the other of the first and second heating elements is turned on to heat the air to be output from the device.

8. The apparatus of claim 7, wherein alternate ones of the predetermined stages apply the first predetermined phase angle to the first heating element and the second predetermined phase angle to the second heating element with intervening ones of the predetermined stages applying the second predetermined phase angle to the first heating element and the first predetermined phase angle to the second heating element.

9. The apparatus of claim 1, wherein the processor is configured to change the predetermined stage of the device only once per 360° cycle of the AC power.

10. The apparatus of claim 1, wherein each of the stages corresponds to a power level of the device ranging from 0% power to 100% power.

11. The apparatus of claim 1, further comprising a circuit configured to filter the AC power input to the device prior to the processor receiving the input AC power.

12. The apparatus of claim 1, wherein the device is a hair dryer configured to output the heated air; and the first heating element and the heat control circuit are each disposed in a handle of the hair dryer.

13. The apparatus of claim 12, further comprising a housing of the hair dryer; and a power cable extending from the housing configured to operatively couple to an AC source;

wherein the handle extends from the housing.

14. The apparatus of claim 12, further comprising a filter circuit disposed in the handle and configured to filter the AC power input to the hair dryer prior to the processor receiving the input AC power;

wherein the filter circuit includes an inductor and two capacitors.

15. The apparatus of claim 1, further comprising a non-transitory computer-readable storage medium storing an algorithm configured to be executed by the processor to control the turning on and off the first heating element.

16. An apparatus, comprising:

a first heating element and a second heating element configured to heat air to be output from a hair dryer powered with alternating current (AC) power;

a temperature sensor configured to measure a temperature of the air to be output from the hair dryer; and a processor communicatively coupled to the first and second heating elements and configured to:

identify which one of a plurality of predetermined stages the hair dryer is operating in, each of the plurality of predetermined stages corresponding to a first predetermined phase angle of the AC power at which the processor is configured to turn on the first heating element; and change the stage the hair dryer is operating in based on whether the measured temperature satisfies a predetermined desired temperature by incrementally transitioning between the plurality of predetermined stages.

17. The apparatus of claim 16, wherein the processor is configured to increase the predetermined stage by one if the measured temperature is below the predetermined desired temperature; and the processor is configured to decrease the stage by one if the measured temperature is above the predetermined desired temperature.

18. The apparatus of claim 16, further comprising a circuit configured to filter the AC power input to the device prior to the processor receiving the input AC power.

19. The apparatus of claim 16, wherein a dead zone is in each 360° cycle of the AC power such that none of the predetermined phase angles are in the dead zone.

20. The apparatus of claim 16, wherein the processor is configured to identify which one of the plurality of predetermined stages the hair dryer is operating in, each of the plurality of predetermined stages corresponding to the first predetermined phase angle of the AC power at which the processor is configured to turn on one of the first and second heating elements and to a second predetermined phase angle of the AC power at which the processor is configured to turn on the other of the first and second heating elements.

21. The apparatus of claim 20, wherein alternate ones of the predetermined stages apply the first predetermined phase angle to the first heating element and the second predetermined phase angle to the second heating element with intervening ones of the stages applying the second predetermined phase angle to the first heating element and the first predetermined phase angle to the second heating element.

22. The apparatus of claim 16, further comprising a non-transitory computer-readable storage medium storing an algorithm configured to be executed by the processor to identify which one of the plurality of predetermined stages the hair dryer is operating in and to change the stage the hair dryer is operating in.

23. A method, comprising:

based on a phase angle of AC power powering a device and based on which one of a plurality of predetermined stages the device is operating in, causing, with a processor, a first heating element of the device heating air to be output from the device to be turned on and off by incrementally transitioning between the plurality of predetermined stages stored in a non-transitory computer readable medium of the device, wherein each of the plurality of predetermined stages correspond to a predetermined phase angle of the AC power necessary to energize the first heating element.

24. A non-transitory computer-readable storage medium comprising a program for execution by the processor, the program including instructions which, when executed by the processor, cause the device to perform the method of claim 23.

* * * * *